United States Patent [19]

Russell

[11] 4,361,188

[45] Nov. 30, 1982

[54] WELL APPARATUS ACTUATING MEANS HAVING PRESSURE ACCUMULATOR MEANS AND METHOD OF USE

[76] Inventor: Larry R. Russell, 6025 Edgemoor, Suite C, Houston, Tex. 77081

[21] Appl. No.: 137,714

[22] Filed: Apr. 7, 1980

[51] Int. Cl.[3] ..... E21B 34/10; E21B 43/12

[52] U.S. Cl. ..... 166/381; 166/319; 166/321; 166/323; 166/374; 166/387

[58] Field of Search ..... 166/314, 69, 319, 320, 166/321

[56] References Cited

U.S. PATENT DOCUMENTS 3,045,759 7/1962 Garrett et al. ..... 166/320

3,827,501 8/1974 Johnson et al. ..... 166/321

*Primary Examiner*—Stephen J. Novosad

*Attorney, Agent, or Firm*—Carl B. Fox, Jr.

[57] ABSTRACT

Well apparatus, in which a pressured fluid accumulator is used to perform a function when the apparatus is disposed downhole in a well, such as to operate a valve to control fluid flow through a tubing string in which the apparatus is disposed. The accumulator is pressure-charged after the apparatus is run into the well by exposing the accumulator to casing pressure, so that the accumulator will thereafter be at a constant pressure. Performance of functions is accomplished by varying the casing pressure to above or below accumulator pressure, and using the pressure differential between the casing and accumulator to operate an actuator, such as a piston, to perform the function. The accumulator pressure may be made as desired by adjustment of the casing pressure at the time the accumulator is charged with pressure after the apparatus has been run into the well.

42 Claims, 20 Drawing Figures

212
71
27a
210
211
71
27
71
88
86
87
81
27
80
84
79
82
61
91
96
78
93
92
94
97

78
102
99
100
61
96
103
108
98
107
106
113
105
114
110
61a
112

105a
105b
105
114
98
133
105c
131
118
120
105d
231
116
134
114
130
121
117
221
140a
141
114
230
140
3
3
122
138
114
142
137a
145
123
232
114
147
150
144
156
124
153
160
154
161
114
152
232
162
114
152
117
125
174
203
173
201
200

152b
126
204
175
176
152a
215
98
172
183
178
213
179
187
186
188
220
197
198
196
191
192
190
193

23
37
33
31
38
39
36
37
40
218
31a
53
51a
41
35
42
45
52
51
43
27
45a
49
46
46
48
35c
54
35a
56
57
67
58
72
59
65
63
69
62
74
71
61
212

105
105a
105b 114
133
98
131
105c
134
118
120
231
105d
116
130
140
121
221
141
117
138
230
140a
122
137a
142
145
147
232
123
144
150
160
156
153
161
154
124
152

WELL APPARATUS ACTUATING MEANS HAVING PRESSURE ACCUMULATOR MEANS AND METHOD OF USE

BACKGROUND OF THE INVENTION

Well apparatuses have been devised and used wherein precharged accumulators containing pressured fluid are used as operating means for manipulative operation of the tools. Since downhole well pressures, temperatures, and solubilities cannot be accurately calculated or predicted, the precharged accumulators do not always operate adequately because the pressured fluid therein may not be charged at the proper pressure. Downhole well pressure includes the pressure resulting from a standing column of fluid in the well, called the fluid hydrostatic pressure, plus additional pressure, if any, imposed on the fluid column. Since the exact vertical height of the hydrostatic fluid column is not accurately known, and because of the fluid gravity multiplier which must be applied to calculate the hydrostatic pressure or head, the fluid hydrostatic pressure is at least to some degree indefinite. Therefore, if a downhole pressured fluid accumulator needs to be pressured relatively closely equal to or above or below another pressure, such as the casing pressure, it can easily happen that the accumulator fluid pressure precharged at the surface will not be of the proper magnitude when the apparatus containing the accumulator is placed downhole. Further, the magnitude of such precharge pressure may exceed safe pressure ratings for the apparatus case. The present invention seeks to provide apparatus wherein the accumulator pressure is created or modified after the apparatus including the accumulator is in its position of use downhole in the well.

SUMMARY OF THE INVENTION

The apparatus according to the invention includes a fluid pressure accumulator which is preferably precharged to a relatively low pressure at the surface, and which is brought to its final pressure charge after the apparatus is placed downhole in the well through a valve assembly provided in the apparatus. Pressure charging of the accumulator downhole is accomplished by exposing the accumulator to a downhole pressure, for example the casing pressure, after the apparatus is placed in its downhole position, to increase the accumulator pressure to its desired value, and then sealing off the accumulator so that its charged pressure will thereafter remain constant.

After downhole charging of the accumulator pressure has been accomplished, the accumulator pressure may be employed for apparatus operation by varying the casing pressure to above or below the accumulator pressure and using the pressure differential for apparatus operation. The accumulator assembly may be used for opening or closing of a valve whereby to control flow through a pipe string, for example, a well tubing, to which the apparatus is connected, or for setting or unsetting a packer between the tubing and a surrounding casing, or to perform any other sort of function actionable by piston reciprocation and/or combined reciprocation and rotation. The operations performed through use of the accumulator may be made reversible or irreversible, the latter being accomplished by locking or latching means preventing an opposite movement. In the well apparatus herein disclosed, an internal ball valve is actuated by use of the differential between the casing pressure and the accumulator pressure. For operation of the ball valve, accumulator pressure and casing pressure are disposed at opposite sides of an internal piston structure which moves a sleeve to operate the ball valve assembly.

A principal object of the invention is to provide well apparatus wherein an accumulator is charged downhole by pressure balancing the accumulator pressure with casing pressure. Another object of the invention is to provide such apparatus wherein tool operation may be achieved by use of casing pressure-accumulator pressure differential whether the casing pressure is above or below accumulator pressure. A further object of the invention is to provide such apparatus wherein the accumulator pressure once charged to the proper value is not subject to change. Yet another object of the invention is to provide such apparatus wherein reciprocating and rotational drives may be realized from accumulator pressure. Another object of the invention is to provide such apparatus which is economical, and which is safe and dependable in operation.

Other objects and advantages of the invention will appear from the following detailed description of preferred embodiments, reference being made to the accompanying drawings.

BRIEF DESCRIPTIONS OF THE DRAWINGS

DESCRIPTIONS OF THE PREFERRED EMBODIMENTS

Figure 1:
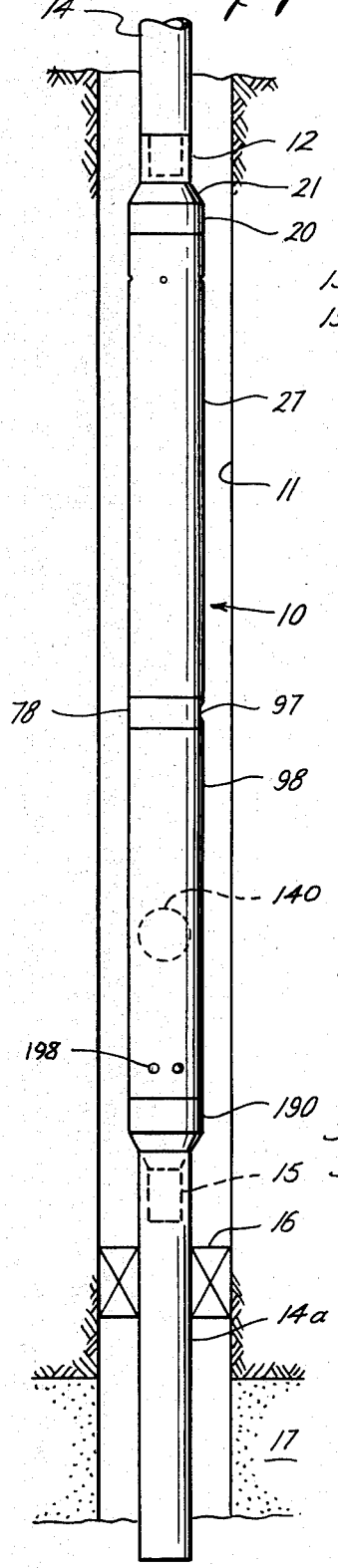
FIG. 1 is a schematic elevation, partly in cross section, showing the manner of installation of the well apparatus in a well.

Referring now to the drawings in detail, and first to FIG. 1, the well apparatus 10 in a preferred embodiment according to the invention is shown disposed in a well opening 11, which may be the interior opening or passage of a well casing (not shown). The apparatus is shown suspended at internally threaded box or socket 12 into which the lower end threads of a tubing 14 are screwed. Additional tubing 14*a* suspended from the wall apparatus is screwed to lower end threads 15 of apparatus 10. A packer 16, which may be of any suitable form, is shown disposed about tubing 14*a* beneath apparatus 10, packer 16 engaging the wall of passage 11. The tubing extends to well formation 17 which will usually be a petroleum formation from which output of a petroleum product is expected.

Figure 2A:
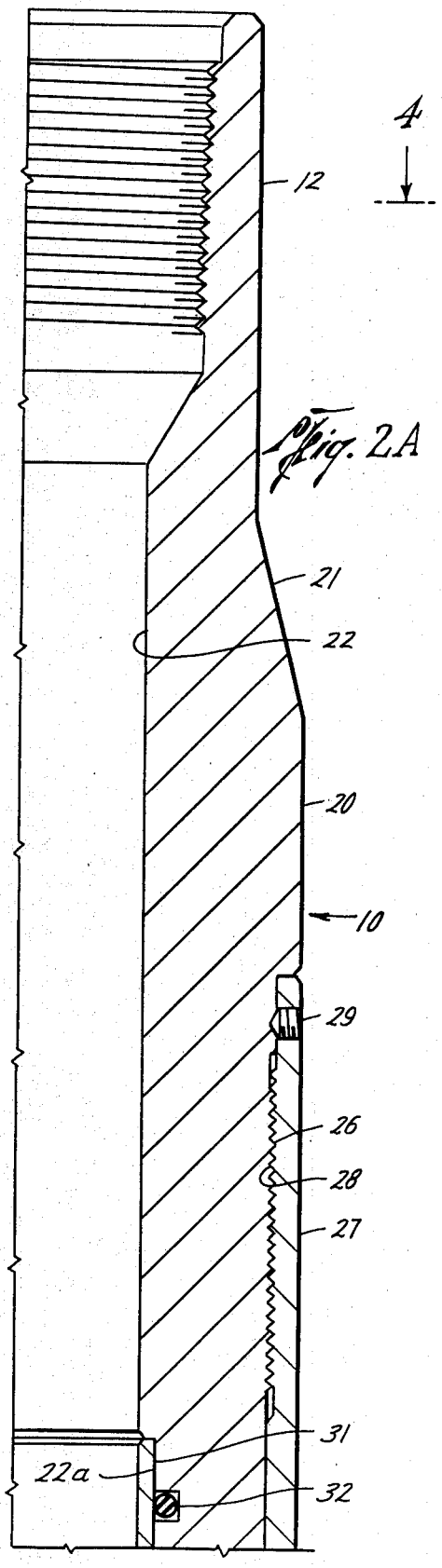
FIGS. 2A–2F are partial vertical cross sections together showing a preferred form of apparatus according to the invention in detail.

Referring to FIG. 2A, top connection member 20 of cylindrical tubular form is conically reduced at 21 to internally threaded round box or socket 12, box 12 being provided to enable connection to the lower end of a tubing string 14, as shown in FIG. 1. Top connection member 20 has concentric bore or passage 22. Member 20 terminates downwardly at 23, FIG. 2B, and thereabove is outwardly reduced and threaded at 26. Tubular upper body member 27 is internally threaded at 28 at its upper end and is screwed onto threads 26 of top connection member 20. Set screw 29 is threaded through a tapped opening through the upper end of upper body member 27 above threads 28 to secure the connection between members 20 and 27. Bore 22 is enlarged annularly at its lower end at 22*a* and the upper end of a loading valve body 31 is disposed around bore portion 22*a*. O-ring seal 32 is provided in a groove around bore portion 22*a* to seal with loading valve body 31. A port 33 is provided through upper body member 27 adjacent the lower end 23 of top connection member 20.

Loading valve body 31 is annularly enlarged at 31*a*. A pair of cylindrical passages 35 are provided through annular enlargement portion 31*a* at opposite sides thereof, passages 35 being reduced at 35*a* at their lower ends. A lock plug 36 is slidably fitted in each passage 35, each being held in place with its upper end flush with the upper side of enlargement 31*a* by shear pin 37. Each plug 36 has an annular recess 38 therearound in which is disposed a lock ring 39. O-ring seals 40–43 are disposed in grooves around each lock plug 36, as shown. Each lock plug 36 is cylindrical and has a concentric passage 45 part way therethrough from its lower end, passage 45 being enlarged at its lower portion 45*a*. Vertical slots 46 are provided at lower passage portion 45*a*. A shoulder 35*c* is formed between passages 35, 35*a*, and the lower end of helical compression valve spring 48 is disposed thereagainst. The upper end of spring 48 is engaged against the lower side of plunger 49, plunger 49 being beveled at its upper portion to engage against the shoulder formed at the upper end of passage portion 45*a*. Slots 46 provide flow passages around the outside of the unseated plunger 49. A cross passage 51, 51*a* is provided through loading valve body portion 31*a* and lock plug 36, passage 51*a* intersecting the upper end portion of passage 45. Annular recess 52 is provided around passage 35 at passage 51*a*, and annular recess 53 is provided around lock plug 36 at passage 51*a*, as shown. Recesses 52, 53 are of the same axial length and extend to the opposite sides of passage 51*a* by the same distance. O-ring seal 54 in a groove around the lower end of body portion 31*a* seals with upper body member 27.

Figure 2B:
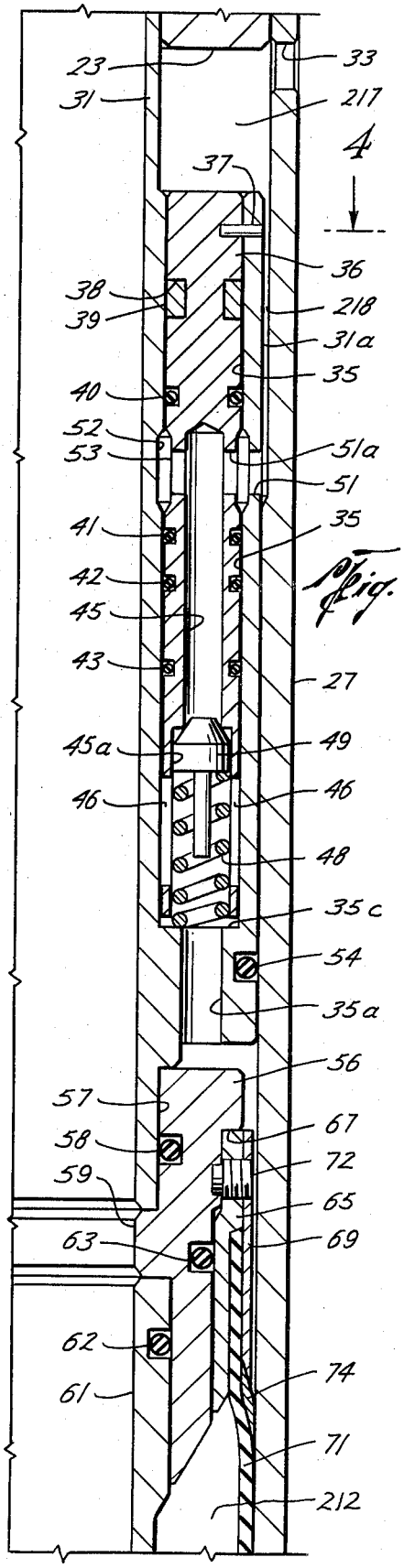
Figure 2C:
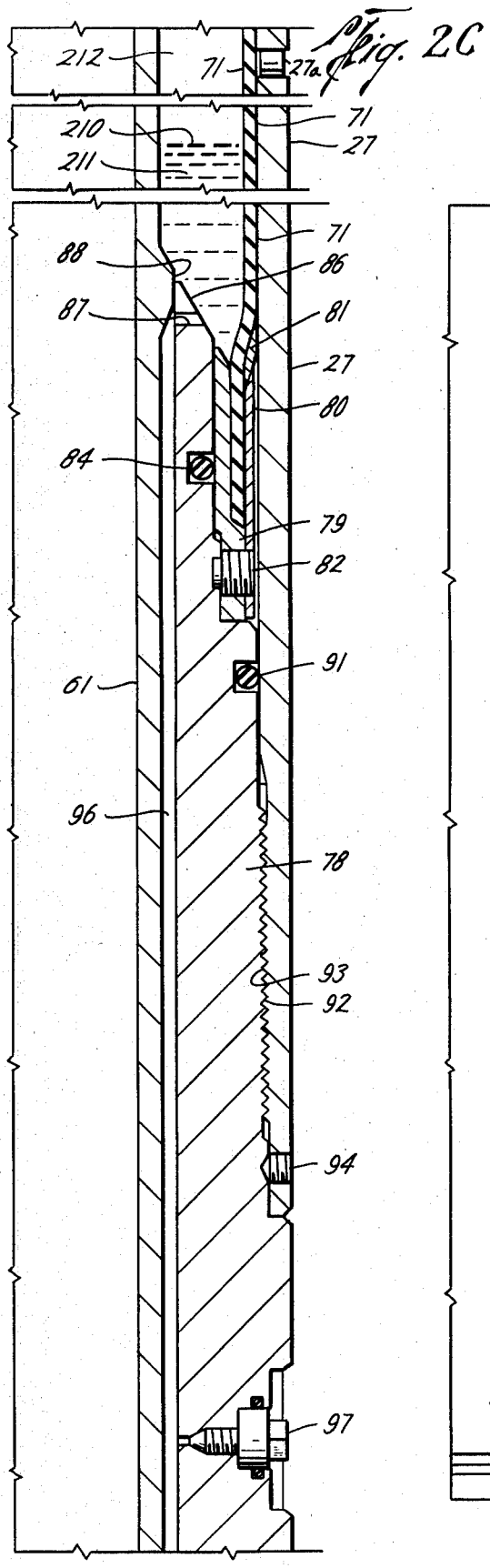

Referring now also to FIG. 2C, the upper end of bladder guide 56, of tubular form, is disposed within recess 57 provided around the lower end of tubular loading valve body 31. O-ring seal 58 disposed in a groove around the interior of guide 56 seals with body 31. Guide 56 has inwardly projecting annular formation 59 the upper side of which engages against the lower end of body 31. The lower side of formation 59 is engaged against the upper end of a tubular inner mandrel 61. O-ring 62 disposed in a groove around mandrel 61 seals between mandrel 61 and bladder guide 56. O-ring 63 disposed in a groove around bladder guide 56 seals between bladder guide 56 and bladder end fitting 65. Bladder end fitting 65 is of stepped tubular form and fits within stepped recess 67 around bladder guide 56. Bladder backup 69, tubular in shape, surrounds bladder end fitting 65, being spaced outwardly therefrom at its lower end.

The upper end of a tubular bladder 71, the interior of which forms a fluid pressure accumulator, is clamped between fitting 65 and backup 69, these elements being held together and fixed to bladder guide 56 by set screws 72, a plurality of which are provided circularly spaced around the apparatus. A tubular flex strip 74 is disposed about bladder 71 at the lower end of bladder backup 69 to protect the bladder at its point of flexure below bladder backup 69. The lower end of tubular bladder 71 is similarly affixed to center connection member 78 by bladder guide member 79, bladder backup 80, flex strip 81, and set screw 82. O-ring seal 84 provided in a groove around center connection member 78 seals between the center connection member and bladder guide 79.

The upper end of the center connection member 78 is conically beveled at 86 and a port 87 is provided through the beveled end. Inner mandrel 61 has an annular outward enlargement 88 therearound which is beveled as shown at its opposite sides. Enlargement 88 engages against the upper end of center connection member 78.

An O-ring 91 disposed in a groove around center connection member 78 seals between the center connection member and upper body member 27 slightly below the lower end bladder connection. Center connection member 78 has external threads 92 therearound engaged with internal threads 92 of upper body member 27, and set screw 94 secures the threaded connection fixing these members together. Annular space 96 between inner mandrel 61 and center connection member 78, and beneath projection 88 on inner mandrel 61, communicates with the interior of bladder 71 through port 87. The valve element 97 is disposed through an opening through center connection member 78 to communicate between space 96 and the exterior of the apparatus and can be used to initially fill the accumulator and to vent the accumulator pressure after removal of the apparatus from the well.

Figure 2D:
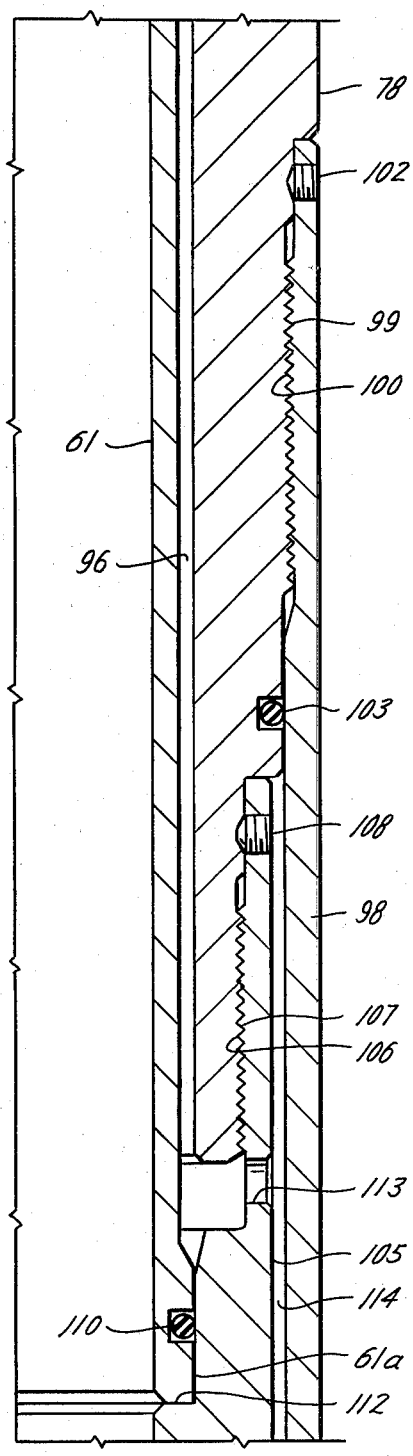

Referring now also to FIG. 2D, the lower end of central connection member 78 is connected to lower body member 98 at threads 99 of the center connection member and threads 100 of lower body member 98. Set screw 102 through lower body member 98 secures the connection. O-ring seal 103 disposed in a circular groove around center connection member 78 below threads 99 seals between the center connection member and the lower body member 98.

A seat holder 105, of tubular form, is connected to the lower end of center connection member 78 at threads 106 of the seat holder and threads 107 of the center connection member, the respective threads being screwed together and the connection secured by a set screw 108. An O-ring 110 around the lower annularly enlarged end 61*a* of inner mandrel 61 seals with seat holder 105. The lower end of inner mandrel 61 abuts against a shoulder 112 of seat holder 105.

A port 113 through seat holder 105 provides fluid communication between annular space 96 and an annular space 114 between seat holder 105 and lower body member 98. Seat holder 105 is outwardly reduced at 116 at its lower end, FIG. 2E, and the upper end of a sleeve 117 is received in the resulting recess and sealed to the lower end of seat holder 105 by O-ring 118 disposed in a circular groove around the lower end of the seat holder.

Sleeve 117 has plural rows 120–126 of spaced lugs spaced axially along the sleeve, to space sleeve 117 from body member 98 completely around the apparatus. Seat 130 is outwardly uniformly reduced at its upper end 131, and the upper end 131 is slidably received in bore 105*a* at annularly enlarged part 105*b* thereof. Bore 105*a* is further enlarged stepwise at 105*c* and 105*d*. O-ring seal 133 provided in a recess around bore portion 105*b* seals between upper end 131 of seat 130 and seat holder 105. A helical compression seat spring 134 has its upper end disposed in bore portion 105*c* and has its lower end disposed against the shoulder between the main body of seat 130 and upper seat portion 131. Spring 134 biases seat 130 downwardly. The upper part of the main body of seat 130 is slidably fitted within bore portion 105*d*.

A pair of ball pusher elements 137*a*, 137*b* of mirror-image forms are disposed one at each side of ball 140, and each has an opening therethrough to receive a central pin 138, a pin 38 being seated in each of opposite sides of ball 140. Ball 140 is seated at its upper side against a spherically beveled end 141 of tubular seat 130. Ball pusher elements 137*a*, 137*b* each has an upwardly facing spherically shaped seat 142 disposed against the lower side of the ball, wiper sleeve 144 having spherically beveled upper end 145 also engaging the lower side of the ball. Wiper sleeve 144 has annulr projection 147 against which the upper end of wiper spring 150 is engaged, the lower end of wiper spring 150 being engaged against the upper end of piston extension 152. Each ball pusher 137*a*, 137*b* is outwardly rounded to slidably engage the interior of sleeve 117, and each has a radially narrowed downward extending portion 153 which is thickened inwardly at 154. Piston extension 152 has a correspondingly shaped upper portion 156 engaged fittedly with portions 153, 154 of the two ball pushers. Pusher retainer 160 is disposed in the space between sleeve 117 and portions 153, 154 of ball pushers 137*a*, 137*b*, being held in place by a set screw 161. O-ring seal 162 is cut or split so that pressure can pass it but substantially all dirt passage therepast is excluded.

Figures 2E, 2F:
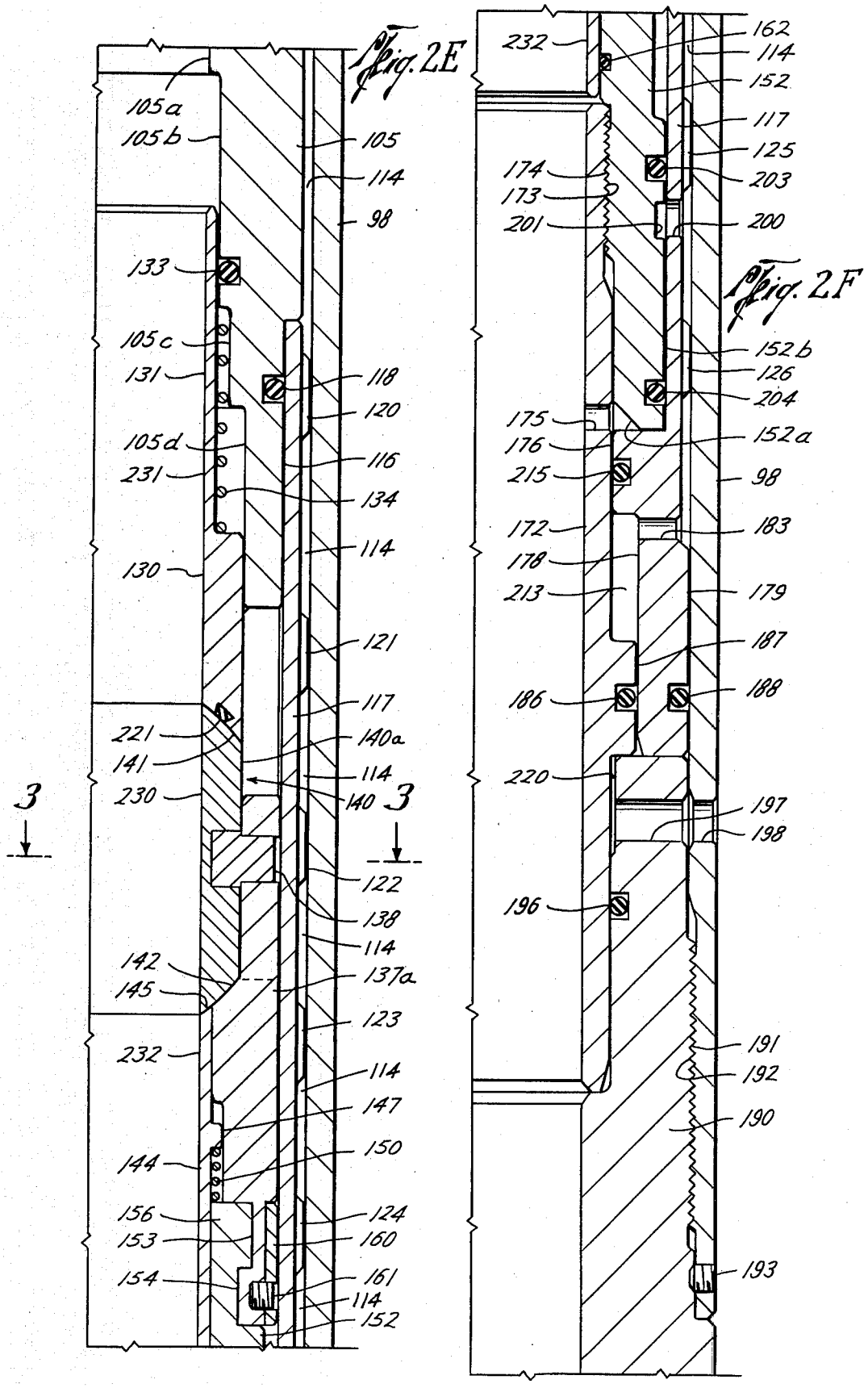

Tubular piston 172, FIG. 2F, has external threads 173 around its upper end which are screwed into internal threads 174 of piston extension 152. A port 175 is provided through piston 172 at the lower end of piston extension 152, which is beveled at its lower inner edge 152*a*. Sleeve 117 has an inwardly thickened portion 176 spaced upwardly from its lower end, and below thickened portion 176 sleeve 117 is relieved inwardly at 178 and thickened outwardly at 179 to be engaged with the inner wall of lower body member 98. Ports 183 are provided oppositely through sleeve 117 immediately below inwardly thickened portion 176 thereof, to communicate with space 114 around sleeve 117. O-ring seal 186 is disposed in a surrounding groove in annularly outwardly projection portion 187 of piston 172 to seal between piston 172 and portion 178 of sleeve 117. An O-ring seal 188 disposed in a surrounding groove in portion 179 of sleeve 117 is provided to seal between sleeve 117 and lower body member 98. The lower side of projection 187 and the lower end of sleeve 117 are at the same level, and the upper end of tubular bottom connection member 190 is disposed thereagainst.

Bottom connection member 190 has external threads 191 around its upper end which are screwed into internal threads 192 around the lower end of lower body member 98, the connection being secured by a set screw 193. An O-ring seal 196 is disposed in a surrounding groove internally of bottom connection member 190 to seal between the lower end of piston 172 and the upper end of bottom connection member 190. Ports 197, 198 are provided through the upper end of bottom connection 190 and the lower end of lower body member 98 at opposite sides of the apparatus, these ports being aligned and of the same size and being disposed above seal 196 and threads 192 of the respective members.

The lower end of bottom connection member 190 is not shown in the drawings except in FIG. 1. As is shown in FIG. 1, the lower end of bottom connection member 190 is in the form of a threaded pin adapted to be screwed into the upper end of tubing 14*a*.

Wrench holes 200 are provided at opposite locations through sleeve 117 above inward projection 176 thereof to provide access to wrench holes 201 formed in the outer surface of outwardly thickened portion 152*b* of piston extension 152, portion 152*b* bearing against the interior of sleeve 117. O-ring seals 203, 204 are provided in grooves around portion 152*b* of piston extension 152 above and below the wrench holes 200, 201 to provide seals between the piston extension and sleeve 117.

When the apparatus is run into a well at the lower end of tubing 14, and having tubing 14*a* connected therebelow, the space within bladder 71 is precharged with a liquid such as an oil to an intermediate level 210, indicated in FIG. 2C, the oil 211 being disposed below this level. Above level 210, the internal annular bladder space 212 is filled with a pressured gas such as nitrogen gas. Liquid 211, which as stated may be an oil, fills port 87, annular space 96, port 113, annular space 114, port 183, and the annular space 213 between the lower end of sleeve 117 and piston 172, space 213 being above projection 187 and below projection 176. An O-ring seal 215 is provided in a groove around projection 176, as shown.

As the apparatus is lowered into the well, hydrostatic casing pressure enters through port 33, FIG. 2B, and through space 217 above lock plug 36, and then through annular space 218 around loading valve body portion 31*a* to enter passage 45 through ports 51, 51*a*. When sufficient, the hydrostaic casing pressure displaces plunger 49 against the bias of spring 48 so that the casing pressure is admitted through passage 35*a* to around bladder 71. The casing pressure moves flex strip 74 inwardly in passing to around the bladder. O-ring seal 91, FIG. 2C, prevents the fluid pressures from passing therepast. As the apparatus moves further down the hole, to a point where the casing hydrostatic pressure value exceeds the original accumulator precharge pressure, the bladder is compressed to equalize the accumulator internal pressure behind bladder 71 to be equal to the hydrostatic casing pressure. Therefore, when the apparatus reaches its destination downwardly in the well, the accumulator pressure is equal to the hydrostatic casing pressure at that point. The casing pressure may be increased above hydrostatic pressure for charging the accumulator, when desired.

Figure 11:
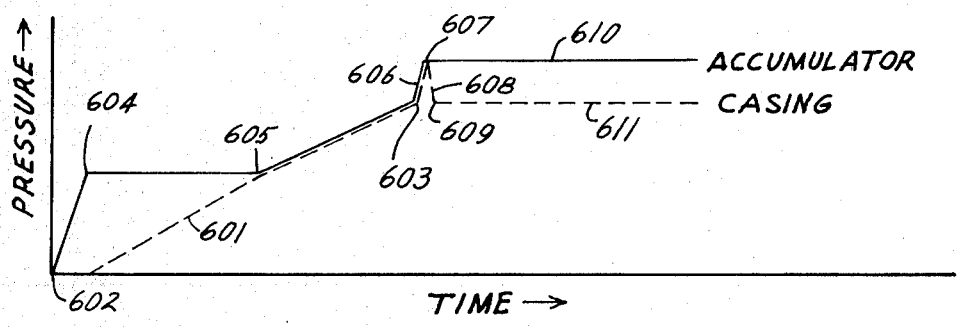
FIG. 11 is a schematic graph showing casing and accumulator pressure changes for the apparatus of FIGS. 2A–2F.

Referring to FIG. 11 of the drawings, the pressure within the accumulator is shown by the solid line and the casing hydrostatic pressure is shown by the dashed line. The casing pressure increases along inclined line portion 601 as the depth of the apparatus in the well increases from surface level 602 to final depth 603, which occurs over the period of time indicated by the graph. The accumulator pressure, which has been precharged to the pressure at point 604, does not increase until the casing pressure exceeds the precharge pressure at point 605, the accumulator pressure thereafter increasing to point 603. The final accumulator pressure charge is along line 606 to point 607, after which the casing pressure is decreased along line 608 to point 609. It is the pressure difference between higher accumulator pressure at level 610 and the reduced casing pressure at level 611 which causes shearing of shear pins 37 (FIGS. 2B and 5A) to allow movement of lock plugs 36 upwardly so that thereafter accumulator pressure is not affected by changes in accumulator pressure.

Figure 5A:
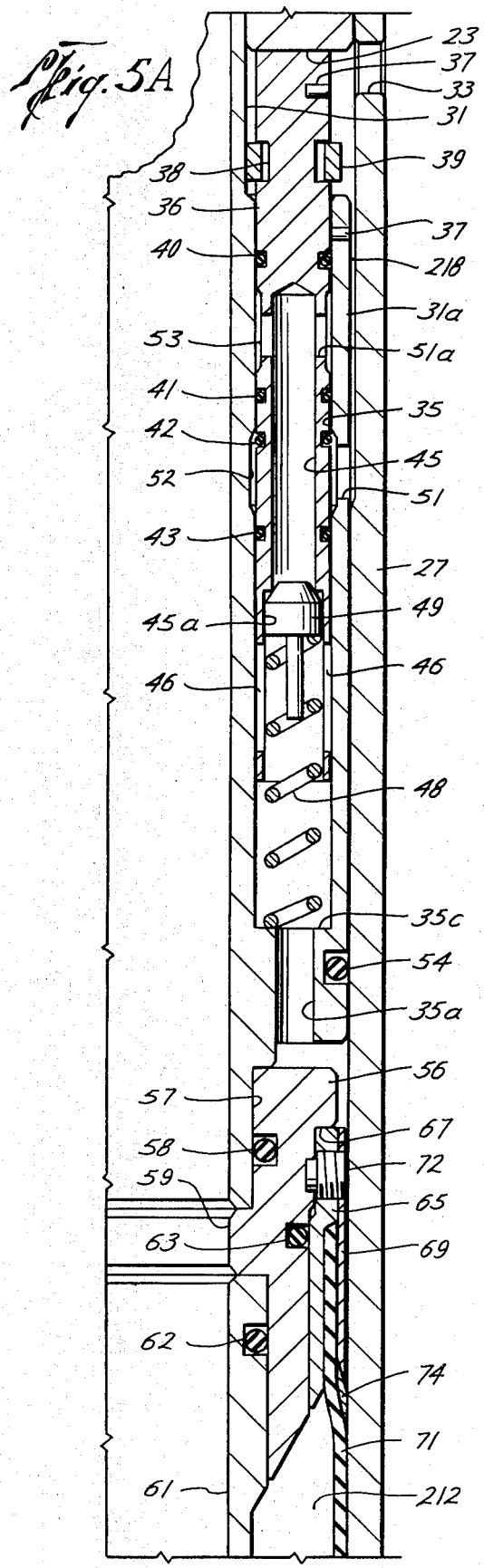
FIG. 5A is a partial vertical cross section showing apparatus elements of FIG. 2B in moved conditions.

Should the pressure outside of bladder 71 at any time exceed the hydrostatic fluid pressure at the outside of the tool, plunger 49 will prevent return flow out of the space around the bladder. Should a sufficiently large pressure differential exist between the space around bladder 71 and the casing space around the apparatus, internal pressure will cause shearing of pins 37 to move lock plugs 36 upwardly to against lower end 23 of top connection member 20. This movement of the lock plugs moves O-ring seals 41, 43 around plugs 36 to positions at opposite sides of ports 51 whereby fluid communication between the space around bladder 71 and the outside of the apparatus is shut off. This condition of the apparatus is shown in FIG. 5A of the drawings. The lock plug 36 has moved upwardly after shearing of pin 37, and lock ring 39 is expanded above the upper end of loading valve body portion 31*a* whereby the lock plugs may not be thereafter returned to a lowered position until the apparatus is removed from the well, and O-ring seals 41, 43 effectively shut off flow through passage 51.

The normal manner for charging of the accumulator involves precharging of the accumulator with oil and gas at the surface, subjecting the accumulator to hydrostatic pressure as the tool is run downhole to its operating position, increasing the hydrostatic or casing pressure if desired to pressure the accumulator to a pressure above hydrostatic casing pressure by a desired amount, in order to insure proper biasing of the actuator piston, and then releasing the excess casing hydrostatic pressure. The result is an accumulator precharged to a pressure exceeding hydrostatic casing pressure, and isolated from further pressure alterations, all done without detailed and mistake-prone calculations and efforts by an operator.

It should be noted that the shear pin will not shear when precharging if the spaces behind the plunger valve (a check valve) and between the check valve and the accumulator bladder are gas or air filled.

A conventional pressure relief valve may be provided, for example, through member 27 adjacent bladder 71, to prevent bursting of member 27 by retained pressure outside of the bladder when the apparatus is brought back to the surface, pressure relief valve 27*a* being shown in FIG. 2C.

Figure 12:
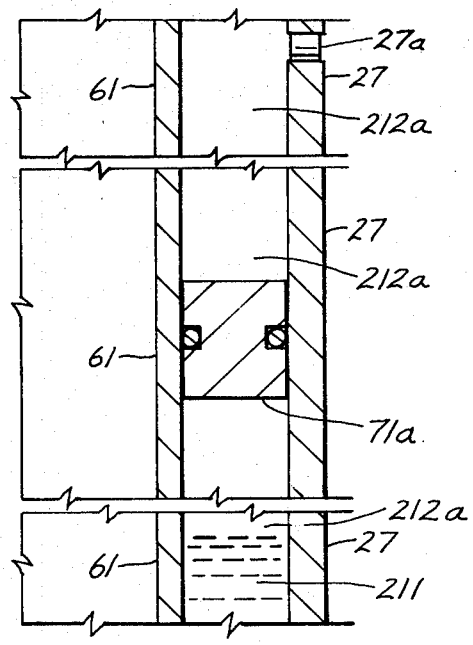
FIG. 12 is a partial vertical cross section showing a modification of the apparatus according to the invention.

In FIG. 12 of the drawings there is shown a modification of the apparatus shown in FIGS. 1–5B, the modification also being applicable in connection with the apparatuses shown in the other drawings. In the annular space 212*a* between inner mandrel 61 and upper body member 27, a slidable free-floating piston 71*a* is provided, the bladder 71 shown in FIGS. 2B and 2C being omitted. Piston 71*a* replaces bladder 71, and provides the same function as bladder 71. The annular space above piston 71*a* is exposed to hydrostatic casing pressure through the valve mechanism of plunger 49 and the associated elements, and the annular space below piston 71*a* provides an internal reservoir space replacing the space interior of bladder 71. The reservoir space below piston 71*a* contains a liquid such as an oil in its lower portion and contains a gas such as nitrogen gas in its upper portion, these being pre-pressured before the apparatus is run into a well, and their pressure is increased in the manner already described when the apparatus is run into the well. The accumulator pressure, as before, is used to operate an actuator to operate a device such as the ball valve device shown. The pressure relief valve 27*a*, as before, provides internal pressure venting from the accummulator when the apparatus is withdrawn from the well.

Figure 5B:
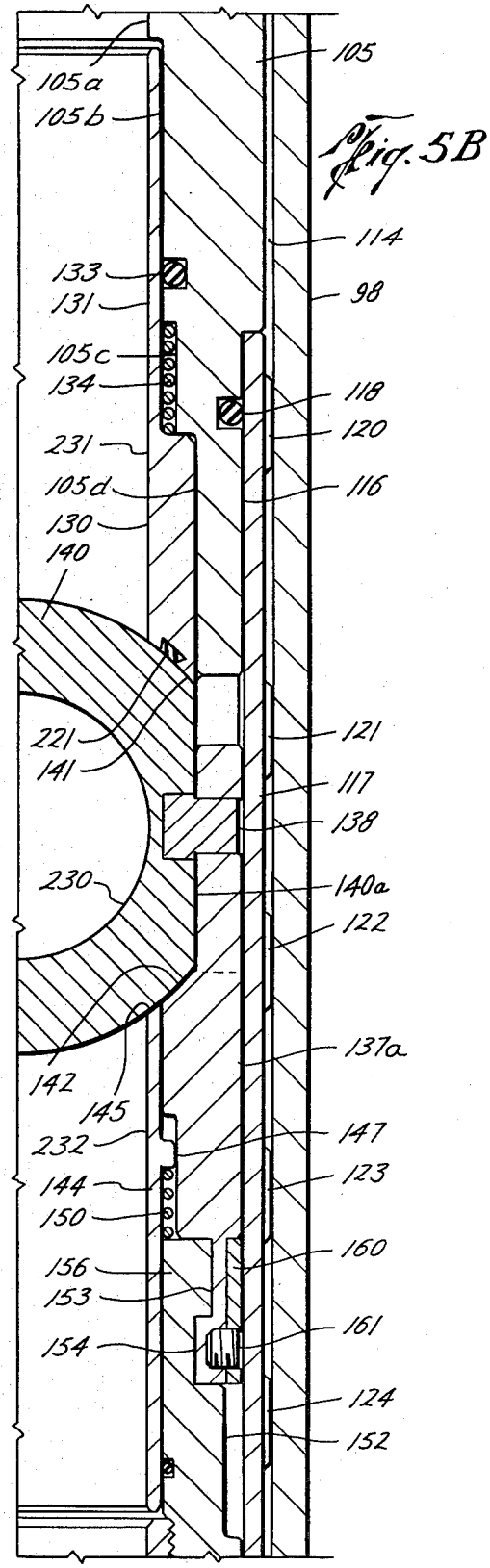
FIG. 5B is a partial vertical cross section showing apparatus elements FIG. 2E in moved condition.

The outwardly protruding portion 187 of piston 172 is the part which performs a piston function. As earlier stated, accumulator pressure enters chamber 213 above formation 187 through the various spaces and passageways mentioned earlier. Casing pressure, which may be hydrostatic casing pressure alone or a higher pressure caused by superimposing a pressure in addition to the hydrostatic pressure, enters through ports 198, 197 to the space 220 of annular shape below formation 187. When the casing pressure exceeds the accumulator pressure, the formation 187 will be slidably moved upward to engage formation 176. Piston extension 152, ball pushers 137*a*, 137*b*, ball 140, seat 130 and wiper sleeve 144 are moved upwardly with piston 172. Spring 150 resiliently engages wiper sleeve 144 with the bottom of the ball so that the ball is engaged with lower end surface 141 of seat 130, surface 141 being provided with a circular seal 221, as shown. Therefore, spring 150 biases ball 140 against seat 41 and seal 221. When seat 130 is moved upwardly, spring 134 is compressed. The positions of these elements after upward movement are shown in FIG. 5B.

Figure 3:
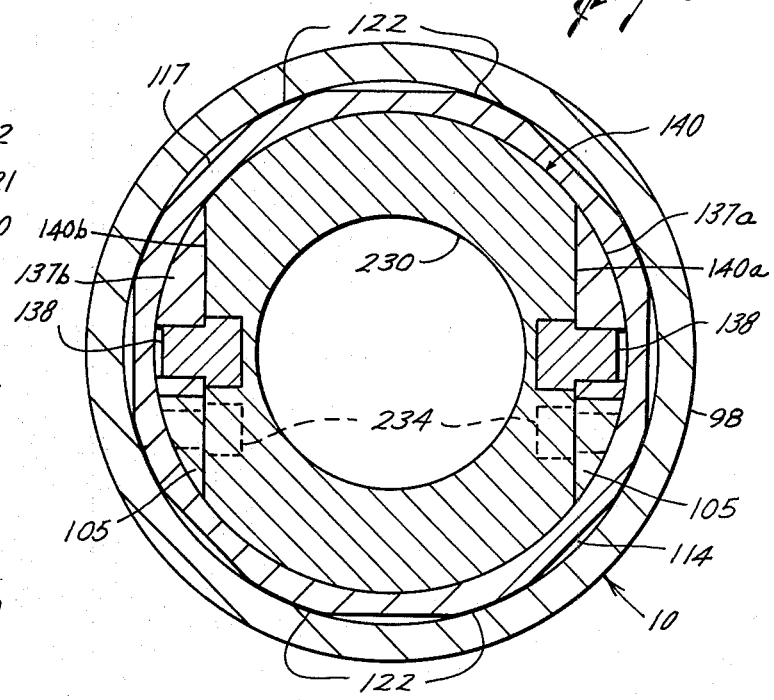
FIG. 3 is a horizontal cross section taken at line 3—3 of FIG. 2E.
Figure 4:
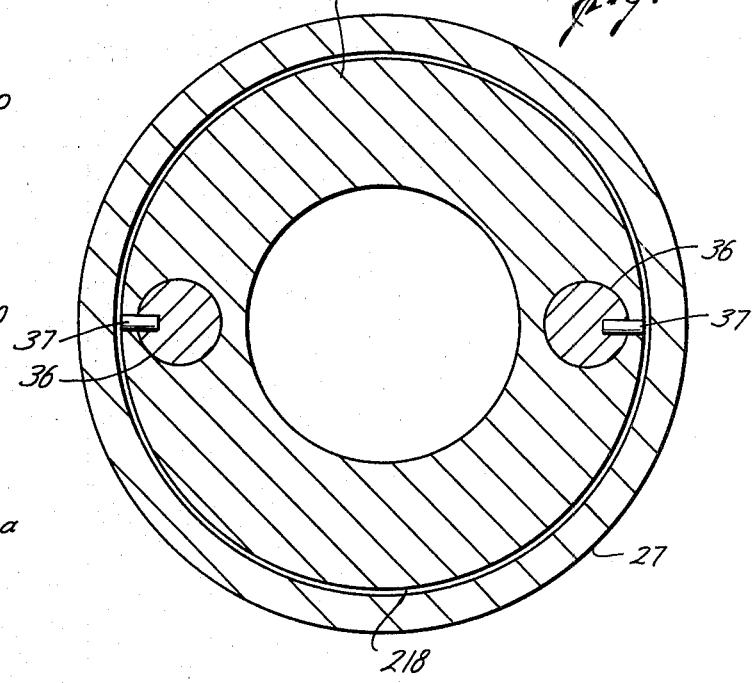
FIG. 4 is a horizontal cross section taken at line 4—4 of FIG. 2B.

Ball 140 has a flow port 230 therethrough which in FIG. 2E is in line with passage 231 through seat 130 and passage 232 through wiper sleeve 144. When the ball and adjacent elements are moved upwardly as in FIG. 5B, the ball 140 is rotated 90° so that passage 230 is transverse to the adjacent passages and the ball valve is closed. Referring to FIG. 3 of the drawings, the central pins 138 are each centered on a common diameter of the ball, while additional pins 234 carried by downward extensions of seat holder 105, one at each side, are each eccentric with regard to the common diameter and pins 138, and aligned one with the other. Pins 234 work in parallel slots on the oppositely disposed ball flats 140*a*, 140*b*, the slots being inclined at angles of about 45° to the axis of passage 230. Therefore, when the ball is raised the pins 234 remain stationary while the pins 138 are moved upwardly, so that the ball is rotated. This ball turning feature is commonly known and is not shown in all detail in the drawings. When the accumulator pressure in space 213 exceeds the casing pressure in space 220, then the piston 172 will be moved downwardly against the upper end of bottom connection number 190, and the ball 140 will be rotated in the opposite direction by 90° to tend to again open the valve.

By provision of a lock ring (not shown), similar to lock ring 39 but of larger diameter, in a groove about piston portion 187 or around piston extension 152, together with a groove outward of the lock ring at the proper elevation, or other suitable latching device, it may be provided that ball valve 140, once closed, may not be opened. Therefore, the valve closing movement may be made irreversible.

Ball valve 40 is closed when casing pressure exceeds accumulator pressure. This condition may occur should the tubing 14, 14*a* or packer 16 leak to increase the pressure around the apparatus. The ball valve 140 tends to open when casing pressure is below accumulator pressure, as may happen in the case of a casing leak. The operation may be reversed so that the valve closes when casing pressure is less than accumulator pressure by simply altering the apparatus such that the ball valve operates on opposite movements of the piston by relocating ball flow port 230 relative to pins 234 by 90° with regard to the portion shown for port 230.

The force acting in a valve ball opening direction when casing pressure is lower than accumulator pressure is the product of the annular area of formation 187 of piston 172 multiplied by the differential between the accumulator and casing pressures, plus the force of spring 134.

The force acting in a valve ball closing direction when tubing pressure above the ball is lower than tubing pressure below the ball is the product of the circular area within seal ring 221 multiplied by the differential between the tubing pressures below and above the ball.

Therefore, when the valve ball is in closed position, the valve will not reopen unless the opening force exceeds the closing force. Thus, for the case where the well pressure in the tubing below the ball is much higher than the tubing pressure above the ball after closure, the ball typically will not reopen by itself when excess casing pressure is removed. To open the ball in such a case, the pressure above the ball must be made nearly equal to the pressure below the ball. This feature permits the tool, if actuated to close by a tubing or packer leak of well pressure into the casing annulus 11, to remain closed, even if the casing pressure leaks off through a casing leak or back into the tubing. This provides a reliable means of detecting tubing or packer leaks from a closed ball 140, since the tool will not reopen without human operator intervention.

By providing splined connections between adjacent elements, for example between elements 130, 105 and 144, 152, or the like, apparatus rotation may be used for apparatus operating purposes. The piston movements may be used to operate other apparatuses than a ball valve, for example, to expand a bladder packer of either inwardly or outwardly converging type, and axial piston movements may be used to drive elements in rotation through use of suitable gearing or camming.

In the apparatus shown in FIGS. 1–5B of the drawings fluid, preferably oil plus nitrogen gas, is entrapped at elevated pressure within the accumulator by reducing casing pressure following pressure charging of the accumulator to close one or more, usually two, valves in the flow passage communicating between the accumulator exterior and the casing space around the tool. Apparatuses may be designed according to the invention wherein the flow passage or passages communicating between the accumulator and the casing space around the tool may be closed by mechanical means instead of by a pressure differential. In the apparatus shown in FIGS. 6A and 6B, closure of the casing pressure communication passage or passages is accomplished by moving the tubing string from which the apparatus is suspended upwardly. In the apparatus shown in FIG. 7, closure of the casing pressure communication passage or passages is accomplished by rotation of the tubing string from which the apparatus is suspended to screw the upper part of the apparatus down at a threaded connection between the upper part of the apparatus and an inner sleeve. In the apparatus shown in FIG. 8 of the drawings, closure of the casing pressure communication passage or passages is accomplished by downward movement of the tubing string from which the apparatus is suspended. In the apparatus shown in FIG. 9 of the drawings, closure of the casing pressure communication passage or passages is accomplished by a shifting of an inner sleeve of the apparatus downward through use of a shifting tool carried by a wireline.

Figure 6A:
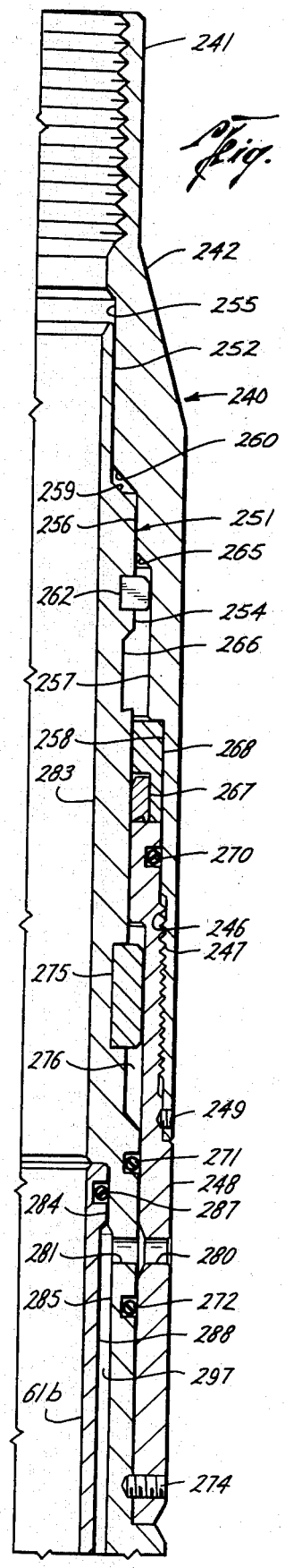
FIGS. 6A and 6B show upper and lower portions, respectively, of a modified form of apparatus, in partial vertical cross section.
Figure 6B:
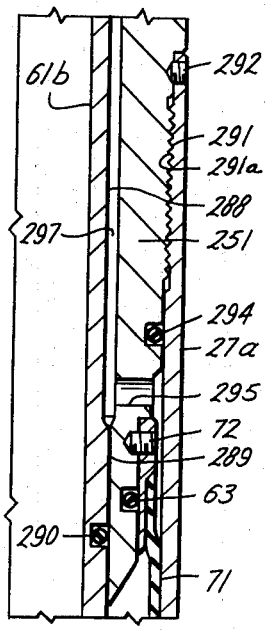

Referring now in detail to FIGS. 6A and 6B of the drawings, top connector body 240 has upper interiorly threaded box 241 for connection of the tool to the lower end of a tubing string. Body 240 enlarges outward frustoconically at 242, and lower interior threads 246 thereof are screwed onto exterior threads 247 of a tubular body 240, the connection being secured by one or more set screws 249. Interior sleeve 251 has thin upper portion 252 below which sleeve 251 is thickened outwardly at 254. Passage 255 of connector body 240 enlarges stepwise at 256, 257, and 258. Sleeve 251 has beveled shoulder 259 below correspondingly beveled shoulder 260 of passage 255. A plurality of circularly spaced lugs 262 are disposed in fitted recesses at the exterior of thickened portion 254 of sleeve 251. Lugs 262 are disposed below conical shoulder 265 of passage 255. Below lugs 262, sleeve 251 has a surrounding recess 266 the upper side of which is conically beveled as shown. A snap ring 267 is carried in an interior recess of ring 268 which is disposed at the upper end of portion 258 of passage 255 between sleeve 251 and connector body 240.

O-ring seal 270 is disposed in a circular groove around sleeve body 248 to seal between sleeve body 248 and connector body 240 above threaded connection 246, 247. O-ring seal 271 disposed in a circular groove around sleeve 251 seals between sleeve 251 and tubular body 248. O-ring seal 272 similarly seals between sleeves 251 and body 248 below O-ring seal 271.

At the lower end of body 248, a shear pin 274 releasably connects body 248 to sleeve 251.

A plurality of circularly spaced splines 275, each disposed in a fitted recess at the exterior of sleeve 251, are engaged between circularly spaced ribs 276 circularly spaced around the interior of body 248 to prevent rotation between sleeve 251 and body 248.

One or more ports 280 are provided through body 248 above its lower end. A corresponding port 281, or ports, are provided through sleeve 251. Passage 283 through sleeve 251 enlarges stepwise downwardly at 284 and 285.

Tubular inner mandrel 61*b*, the upper end of which is disposed within portions 284, 285 of passage 283, has O-ring seal 287 therearound in a suitable circular groove to seal between sleeve 251 and tubular inner mandrel 61*b*. Tubular inner mandrel 61*b* is reduced outwardly at 288, from just above port 281. Mandrel 61*b* enlarges outwardly at 289 and has O-ring seal 290 in a suitable circular groove therearound to seal between mandrel 61*b* and the lower end of sleeve 251.

The lower end of sleeve 251 has the form of bladder guide 56 shown in FIG. 2B and serves the same function. The upper end of tubular bladder 71 is connected to the lower end of sleeve 251 in the same manner as was described for the earlier embodiment, all details of the connection not being completely shown in FIG. 6B but the same reference numerals as were earlier employed being used in FIG. 6B for corresponding elements of the bladder connection.

Tubular inner mandrel **61*b* has the same form as tubular mandrel 61 of FIGS. 1–5B in the portion thereof which extends below the portion shown in FIG. 6B. Upper body member 27*a*, which below the portion thereof shown in 6B corresponds to form to upper body member 27 of the FIG. 1–5B embodiment, is connected at its upper interior threads 291*a* with exterior threads 291 of sleeve 251. Set screw 292 (one or more) secures the threaded connection. O-ring 294 disposed in a circular groove around sleeve 251 seals between sleeve 251 and the upper end of upper body member 27*a*. Port 295 through sleeve 251, one or more being provided, communicates between annular passage 297 between sleeve 251 and mandrel 61*b*, annular passage 297 terminating below ports 295**.

Prior to upward movement of the supporting tubing string and top connector body 240 to close the flow passage, a flow passage is provided through ports 280, ports 281, annular passage 297, and ports 295 to the annular space around tubular bladder 71. Casing pressure entering through this passage system to the exterior of bladder 71 is employed to pressure the precharged liquid and gas, for example, oil and nitrogen gas, inside of the bladder. After the fluids within the bladder have been suitably pressured, communication between the bladder exterior and the casing pressure is shut off by upward movement of the supporting tubing string to shear pin 274 and to draw the top connector body 240 and body 248 upwardly with respect to sleeve 251. After sufficient upward movement of bodies 240 and 248 has occurred, snap ring 267 contracts inwardly to enter recess 266, and O-ring seals 271, 272 seal above and below ports 281 against the interior of body 248 below ports 280 to prevent entry of casing pressure into ports 281 and annular passage 297. Thereafter, the pressure within the accumulator space within bladder 71 is effectively sealed from casing pressure at the outside of the apparatus.

The portion of the apparatus below the portion shown in FIG. 6B is as shown in FIGS. 1–5B, and the functions and utility thereof, and manner of operation, are the same as have already been described.

Figure 7:
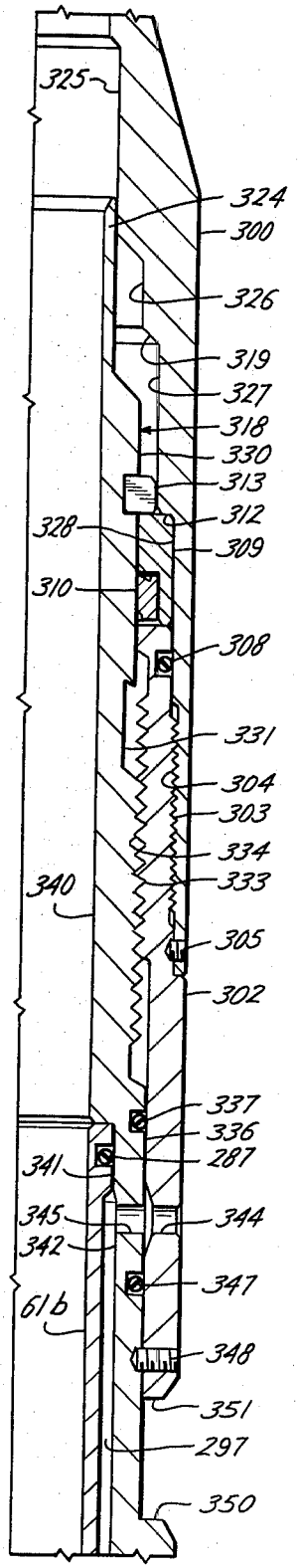
FIG. 7 is a partial vertical cross section showing another modified form of apparatus according to the invention.

Referring now to FIG. 7 of the drawings, the apparatus shown therein includes top connector body 300, which may be identical with top connector body 240 of FIG. 6A, only the lower portions of top connector body 300 being shown in FIG. 7. Tubular body 302 has exterior threads 303 at its upper end which are screwed into interior threads 304 at the lower end of body 300. Set screw 305 (one or more) secures the threaded connection. An O-ring seal 308 disposed in a circular groove around the upper end of body 302 seals between bodies 300, 302 above the threaded connection. Ring 309, having a snap ring 310 in a recess around its interior lower side, is fixed in place between the upper end of body 302 and downwardly facing shoulder 312. A plurality of lugs 313, at least three of which are preferably provided, are disposed in circularly spaced recesses at the exterior of the sleeve 318. Tapered shoulder 319 of body 300 is moved toward the upper sides of lugs 313 when body 300 is moved downwardly with respect to body 318.

Sleeve 318 has upper thin walled portion 324 which is slidable in passage portion 325 of body 300. The body 300 passage enlarges stepwise at 326, 327, and 328. Lugs 313 are disposed slidably against portion 327 of the passage. Ring 309 is disposed in the upper part of portion 328 of the body 300 passage. Sleeve 318 is enlarged outwardly at 330 and has an outwardly facing snap ring receiving groove 331 therearound spaced below lugs 313. Below groove 331, sleeve 318 has external threads 333 formed therearound which engage threads 334 at the interior of body 302. Below threads 333, sleeve 318 is further enlarged outwardly at 336, and an O-ring seal 337 is disposed in a circular groove therearound to form a seal between sleeve 318 and body 302.

Passage 340 of sleeve 318 is enlarged in diameter at 341, and is further enlarged in diameter at 342. One or more ports 344 are provided, circularly spaced, through the lower end of body 302. Sleeve 318 has a corresponding number of ports 345 each in register with a port 344. An O-ring seal 347 is disposed in a circular groove around sleeve 318 below port 345 to form a seal between sleeve 318 and body 302. A shear pin 348 provides a releasable connection between body 302 and sleeve 318.

Sleeve 318 has upwardly facing exterior shoulder 350 which is spaced below lower end 351 of body 302 when the apparatus is in the condition shown in FIG. 7. Tubular inner mandrel **61*b*, previously described with regard to FIGS. 6A and 6B, has O-ring seal 287 in a circular groove around its upper end to form a seal between mandrel 61*b* and sleeve 318. Below the portion thereof shown in FIG. 7, the apparatus is identical with that described in connection with FIG. 6B and FIGS. 1–5B**.

Ports 344, 345 provide casing fluid into annular passage 297, as before. The casing fluid pressure is employed for compressing the fluid, oil and gas, for example oil and nitrogen gas, within the tubular accumulator bladder 71. After the bladder has been pressure charged, the casing fluid pressure communication to the accumulator may be shut off by appropriate rotation of the tubing string from which the apparatus is suspended, causing rotation of top connector body 300 and body 302 affixed thereto to shear pin 348. Body 302 moves downwardly on threads 333. When snap ring 310 reaches the location of groove 331, the snap ring contracts inwardly into groove 331 to fix the outer apparatus elements against upward movement with respect to sleeve 318. Ports 344 are moved downwardly so that O-ring seals 337, 347 seal with body 302 at opposite sides of ports 345. In this way, casing fluid pressure is effectively shut off from access into annular passage 297, whereby the space around the bladder 71 is sealed off. Therefore, after the accumulator has been pressure charged and after ports 345 have been closed, the apparatus is in condition to be operated as has been described for the FIGS. 1–5B embodiment of the apparatus.

Figure 8:
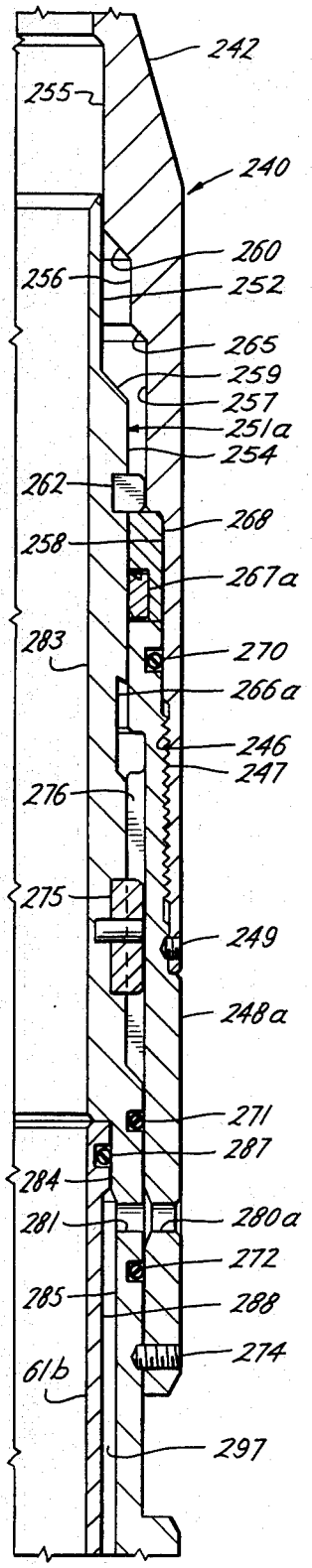
FIG. 8 is a partial vertical cross section showing yet another modified form of apparatus according to the invention.

Referring now to FIG. 8 of the drawings, top connector body 240 is the same as was described with regard to FIG. 6A. Body **248*a* is identical with body 248 of FIG. 6A, except that port 280*a* is at a lower location than is port 280 of body 248. Ring 268 is the same as ring 268 of FIG. 6A, the snap ring 267*a* being the same as snap ring 267** of FIG. 6A except being in inverted position.

Sleeve **251*a* is identical with sleeve 251 of FIG. 6A, except that the snap ring latching groove 266*a* is at a lower location than groove 266 of sleeve 251, and is in inverted disposition. All of the other elements of FIG. 8 are the same as were described and shown with regard to FIG. 6A, and the apparatus portion shown in FIG. 6B forms a continuation below the apparatus portion shown in FIG. 8. The apparatus elements which have been described with regard to FIG. 6A will not be redescribed in connection with FIG. 8. Below the apparatus portions shown in FIG. 8 and FIG. 6B, the apparatus is the same as the lower part of the apparatus shown in FIGS. 1–5B**.

Figure 9:
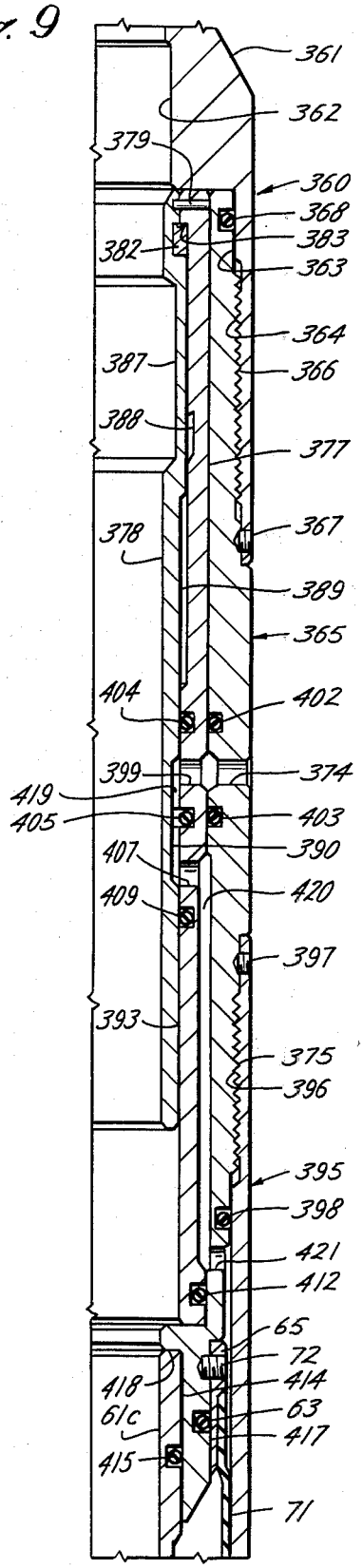
FIG. 9 is a partial vertical cross section showing another form of apparatus according to the invention.

Another form of the apparatus is shown in FIG. 9 of the drawings. Top connector body 360 is conically reduced upwardly at 361 to terminate to a threaded box or socket (not shown) which is connected at the lower end of a tubing string for suspension of the apparatus in a well. Passage 362 of connector body 360 is enlarged at 363 and has lower internal threads 364. Tubular upper body 365 has upper external threads 366 which are screwed into threads 364, the threaded connection being secured by at least one set screw 367. An O-ring seal 368 is provided in a circular groove around the upper end of body 365 to seal between body 360 and body 365. Body 365 has a fluid flow port 374 therethrough intermediate its length. External threads 375 are provided at the lower end of body 365.

Sleeve 377 is fitted within body 365, as shown. A wireline tool to engage sleeve 378 is fitted within sleeve 377, as shown. Shear pin 379 releasably connects sleeves 377, 378 at their upper ends. Snap ring 382 is disposed in a circular groove around the outer surface of the upper end of sleeve 378. Snap ring 382 is engaged with shoulder 383 of sleeve 377 when the apparatus is in the condition shown in FIG. 9. A wireline tool engaging recess 387 is provided around the interior of sleeve 378 near the upper end of sleeve 378.

Sleeve 377 has a snap ring latching recess 388 interiorly thereof at a location below snap ring 382. The outside diameter of sleeve 378 is relieved at 389 below recess 387. The outside diameter of sleeve 378 is further relieved at 390. The inside diameter of sleeve 377 is decreased at its lower portion 393.

A tubular upper body 395 has interior threads 396 which are screwed onto threads 375 of body 365, the threaded connection being secured by one or more set screws 397. O-ring seal 398 disposed in a groove around the lower end of body 365 seals between body 365 and upper body 395.

Sleeve 377 has a plurality of circularly spaced ports 399 therethrough each in register with one of the ports 374. O-ring seals 402, 403 disposed in circular grooves around the interior of body 365, respectively above and below ports 374, seal between body 365 and sleeve 377. O-ring seals 404, 405 disposed in interior circular grooves respectively above and below ports 399 seal between sleeves 377, 378, the seal at O-ring 405 being effective only in certain positions of the apparatus elements. Sleeve 377 has a plurality of circularly spaced ports 407 therethrough below O-ring seal 405, and an additional O-ring seal 409 is provided in a circular groove around the interior of sleeve 377 below ports 407 to provide a seal between sleeves 377, 378. O-ring seal 412 disposed in a circular groove around the lower end of sleeve 377 forms a seal between the lower end of sleeve 377 and the lower end of body 365.

Tubular inner mandrel **61*c* is identical with mandrels 61 and 61*b* of the other embodiments, except at its upper end where outwardly thickened portion 414 is of greater vertical length than in the mandrels of the other embodiments. O-ring seal 415 is disposed in a circular groove around the upper end of mandrel 61*c* and seals between the mandrel and the upper bladder guide 417. Bladder guide 417, which forms the lower end portion of the body member 365, has inwardly projecting downwardly facing shoulder 418 disposed against the upper end of mandrel 61*c*. In other respects, bladder guide 417 is similar in structure to the bladder guides of the other embodiments, and further description will not be given here. Reference numerals used before are applied to some elements of the bladder guide 417**, and the former descriptions apply.

A fluid flow passage communicating between the tool exterior and the outside of tubular bladder 71 is provided by ports 374, ports 399, annular space 419, ports 407, annular space 420, and plural circularly spaced ports 421 through the lower part of body 365 below O-ring 398. As before, fluids within the bladder 77 are pressured by casing fluid pressure entering through the described passage system. After the accumulator pressure has been increased to the desired level by imposition of casing fluid pressure, the passage system may be shut off by use of a wireline-run shifter tool which may be engaged in recess 387 of sleeve 378. The function of the shifter tool (not shown) is to shear pin 379, thereby releasing sleeve 378 from sleeve 377, and moving sleeve 378 downwardly relative to the outer elements. When sleeve 378 is moved downwardly, snap ring 382 becomes engaged in recess 388 to prevent later upward movement of sleeve 378. The outer cylindrical surface of sleeve 378 bridges between O-ring seals 404, 405 to effectively close off the inner ends of ports 399. Thereby, the flow passage from the tool exterior to the outside of bladder 71 is closed, and accumulator pressure will not thereafter be affected by changes in casing fluid pressure. The remainder of the apparatus, below that portion of the apparatus shown in FIG. 9, is the same as that heretofore described in connection with the other embodiments, and is operated in the same manner.

Figure 10A:
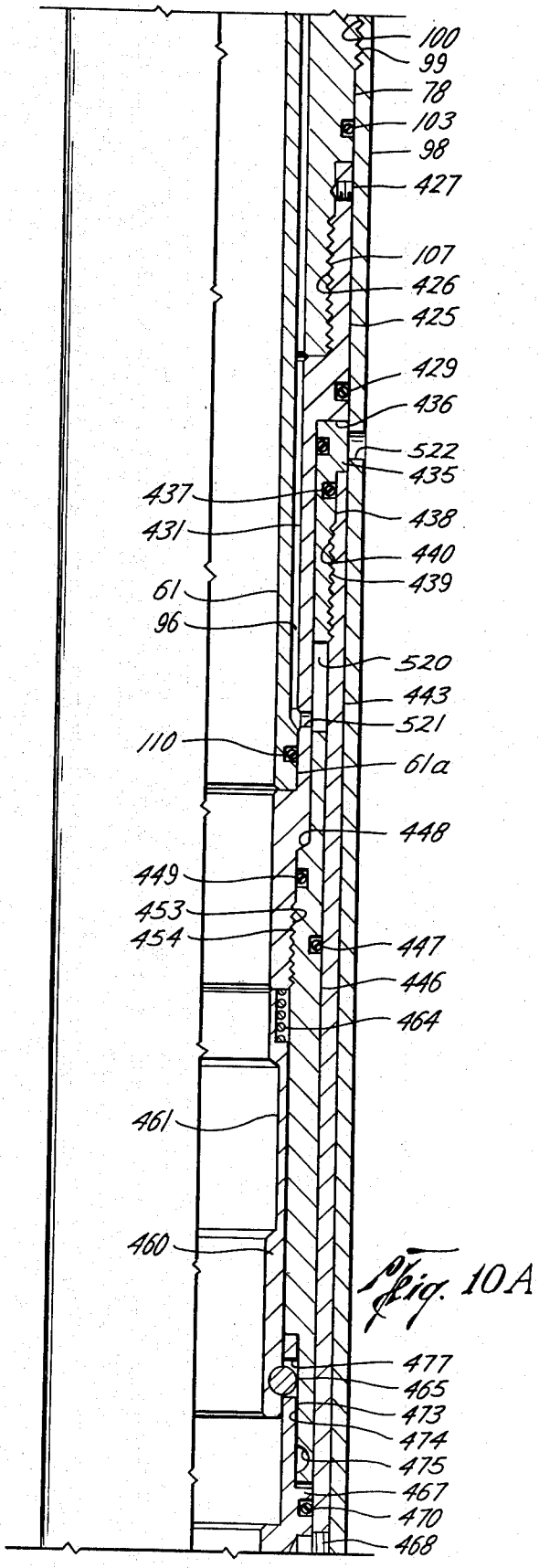
FIGS. 10A and 10B show another form of apparatus according to the invention, in partial vertical cross section.
Figure 10B:
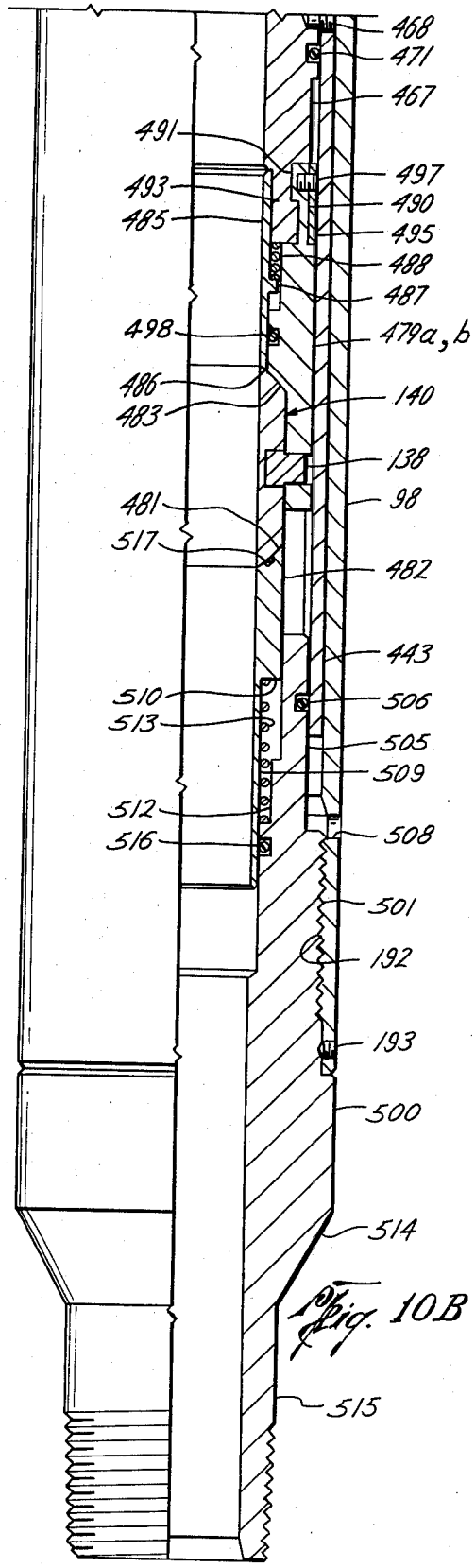

Another embodiment of apparatus according to the invention is shown in FIGS. 10A and 10B. In this form of the apparatus, the apparatus is the same from center connection member 78 upwardly as was shown in any of FIGS. 1–5B, 6A–6B, 7, 8, or 9 of the drawings, and only the portion of the apparatus from center connection member 78 downwardly is shown in FIGS. 10A and 10B. Inner tubular mandrel 61 and lower body member 98 are the same as in the FIG. 1–5B embodiment.

Tubular member 425 has upper internal threads 426, in the form of an internally threaded socket, which are screwed onto threads 107 of center connection member 78. The threaded connection is fixed by at least one set screw 427. O-ring seal 429 in a circular groove around member 425 seals between member 425 and lower body member 98, as shown. The lower portion 431 of member 425 is upset concentrically inwardly to have the same inner diameter as center connection member 78, and is spaced annularly outwardly of the lower portion of mandrel 61. Piston 435 is disposed below shoulder 436 of member 425 and has O-ring seal 437 in a circular groove around its interior near its upper end. Piston 435 is relieved outwardly at 438 and has external threads 439. Threads 439 are screwed together with threads 440 of sleeve 443.

Sleeve 446 is disposed inwardly of sleeve 443 and has O-ring seal 447 in a circular groove therearound to seal with sleeve 443. Sleeve 446 has shoulder 448 and is thickened inwardly therebelow, and has seal 449 in a circular interior groove to seal with member 425. Member 425 has external threads 453, and sleeve 446 has internal threads 454, these being screwed together to connect sleeve 446 to member 425. O-ing seal 110 forms a seal between the lower end of mandrel 61 and the inner surface of member 425.

The lower end of member 425 engages the upper end of a wireline tool engagement sleeve 460, the latter having a wireline tool engagement recess 461 at its interior. A helical compression spring 464 is disposed in a recess around the upper end of sleeve 460, spring 464 being engaged between the lower end of member 425 and the bottom of the recess, to bias sleeve 460 downwardly.

A plurality of circularly spaced balls 465 are disposed in a semi-toroidal groove which is circularly spaced around the lower end of sleeve 460. Piston extension 467 is connected to sleeve 443 at outwardly threaded connection pin 468, which is engaged through a threaded opening through sleeve 443 and is received into a cylindrical recess in the outer side of piston extension 467. Sleeve 443 is connected to piston 435 at threaded connection 439, 440, and both sleeve 443 and piston extension 467 are moved longitudinally of the well when the piston is moved. O-ring seals 470, 471 are respectively disposed in circular grooves around piston extension 467 above and below pin 468 to seal between the piston extension and sleeve 443. Sleeve 443 functions as a first piston extension, and piston extension 467 functions as a second piston extension.

Piston extension 467 has thin walled tubular upward portion 473 which is received in recess 474 interiorly at the lower end of sleeve 446. A semi-toroidal groove 475 is peripherally aligned with the balls 465. A plurality of circular openings 477 are provided through portion 473 of the piston extension 467 at the locations of the balls 465, the balls being movable through the openings 477.

A pair of ball pusher elements **479*a*, 479*b* of mirror-image forms are disposed one at each side of ball 140, and each has an opening therethrough to receive a central pin 138, a pin 138 being seated in each of opposite sides of ball 140 as in FIGS. 1–5B. Ball 140 is seated at its lower side against a spherically beveled end 481 of tubular seat 482. Ball pusher elements 479*a*, 479*b* each has a downwardly facing spherically shaped seat 483 disposed against the upper side of the ball, wiper sleeve 485 having spherically beveled lower end 486 also engaging the upper side of the ball. Wiper sleeve 485 has annular projection 487 against which the lower end of compression spring 488 is engaged, the upper end of compression spring 488 being engaged against the lower end of piston extension 467. Each ball pusher 479*a*, 479*b* is outwardly rounded to slidably engage the interior of sleeve 443, and each has a radially narrowed upward extending portion 490 which is thickened inwardly at 491. Piston extension 467 has a correspondingly shaped lower portion 493 engaged fittedly with portions 490, 491 of the two mirror image positioned ball pushers. A pusher retainer 495 is disposed in the space between sleeve 443 and portions 490, 491 of each ball pusher 479*a*, 479*b*, being held in place by a set screw 497. Seal 498** is provided to exclude dirt movement therepast.

Lower connection body 500 has external threads 501 engaged with internal threads 192 of lower body member 98. The threaded connection is secured by set screw 193. Lower connection body 500 is diametrically reduced at 505, and O-ring seal 506 is disposed therearound in a suitable circular groove to seal between body 500 and the lower end of sleeve 443. A port 508 through lower body member 98 permits ingress of casing fluid pressure into the annular space below the lower end of sleeve 443.

Seat 482 has lower thin-walled portion 509 below shoulder 510, and connection body 500 has recess 512 within which the lower end of helical compression spring 513 is engaged, the upper end of spring 513 being engaged with shoulder 510 of seat 482.

Lower connection body 500 is frustoconically reduced downwardly at 514, and therebelow an externally threaded pin 515 is provided for connection to a downwardly extending continuation of the tubing string from which the apparatus is suspended.

An O-ring seal 516 is provided in a circular groove around the interior of lower connection body 500 to seal between lower connection body 500 and portion 509 of seat 482. A ring shaped seal 517 is provided in a groove around seat 481 to seal between the seat and ball 140.

Accumulator pressure is provided in space 520 below piston 435 through annular passage 96 and port 521 through body 425. Casing fluid pressure enters to above the piston through port 522 through lower body member 98. The casing fluid pressure acting on the upper end area of piston 435 equal to the upper end area of sleeve 443 is balanced by casing fluid pressure entering beneath the lower end of sleeve 443 through port 508. Therefore, casing fluid pressure entering to above the piston 435 through port 522 effectively acts only on an upper area of the piston equal to the lower end area of the piston above space 520.

When casing fluid pressure is increased to exceed accumulator pressure, piston 435 is moved downwardly, sleeve 443 and piston extension 467 moving downwardly therewith. Downward movement of piston 467 therefore causes movement of ball pushers **479*a*, 479*b* downwardly to cause rotation of ball 140 in the manner which was described in connection with FIGS. 1–5B. Ball 140 is in inverted position with respect to its position in the FIGS. 1–5B embodiment. The pins 234 at opposite sides of the ball, which in the case of the apparatus of FIGS. 10A, 10B extend between the ball 140 and upward extensions of stationary connection member 500, at opposite sides, as were best shown in FIG. 3 for the earlier embodiment, are not shown in FIG. 10B because of space limitations with regard to a clear showing of the same. It will be understood that the pins 234 restrain the ball against a longitudinal movement at a pivotal axis between the pins 234, so that longitudinal movements of pins 138 at opposite sides of the ball cause 90° rotation of the ball to move it to closed position with respect to the central vertical passage through the apparatus. The central vertical passage through the apparatus is closed when the ball is rotated about pins 138 90° from the position thereof shown in FIG. 10B**.

When piston extension 467 is moved downwardly in ball closing movement, by imposition of casing pressure higher than accumulator pressure above piston 435, the balls 465 and sleeve 460 are moved downwardly until the balls 465 are in positions enabling them to enter the recesses 475, moving through the passages 477 in such movement. The balls are moved from their positions in the semi-toroidal groove around the outer surfaces of sleeve 460 by downward movement of sleeve 460 by bias of spring 464, so that the recess in sleeve 460 passes to below the recess 475. After this movement has occurred, the balls effectively latch piston extension 467 in its downwardly moved position so that the ball valve 140 may not be rotated to open position until a wireline tool has been lowered into the well and engaged in recess 461 of sleeve 460 to draw 460 upwardly against the bias of spring 464. Before the wireline tool is thus employed, the pressures on piston 435 must be adjusted by lowering of the casing pressure to below accumulator pressure so that piston extension 467 is biased toward upward movement, so that balls 465 will be forced out of recesses 475 as the ball recesses in sleeve 460 arrive at the balls in wireline-actuated upward movement of sleeve 460. The balls are thus moved back to their positions as shown in FIG. 10A, and piston extension 467 moves upwardly to open the ball valve. The apparatus as presented provides an effective means for maintaining the ball valve in closed condition, yet provides that the ball valve may be reopened when desired by upward manipulation of sleeve 460 by a suitable wireline tool.

The apparatus presented is relatively simple in form and inexpensive to manufacture. The parts are mainly in the form of sleeves which are inexpensive to produce, and because of the provision of O-ring seals the tolerances need not be extremely close. The accumulator charging downhole eliminates the necessity for close calculations and eliminates problems resulting from errors in calculation which frequently occur. The apparatuses are strong and reliable and simple in use so that extensive operator training is not necessary.

While preferred embodiments of the apparatus have been described and shown in the drawings, many modifications thereof may be made by a person skilled in the art without departing from the spirit of the invention, and it is intended to protect by Letters Patent all forms of the invention falling within the scope of the following claims.

I claim:

1. Well apparatus, comprising tubular body means having connection means at its upper and lower ends whereby said apparatus may be lowered into a well connected in a pipe string, pressure accumulator means associated with said tubular body means for holding a separate fluid therein under pressure, control valve means for admitting pressuring fluid to pressure said separate fluid within said accumulator from the exterior surface of said apparatus, means for preventing movement of said control valve means to open to prevent outflow of said pressuring fluid, actuator means exposed to the pressure of said separate fluid within said accumulator at a first surface and exposed to the pressure of fluid at the exterior of said apparatus at a second surface whereby said actuator means may be operated in response to pressure differentials between said pressures at said first and second surfaces, and movable means adapted to be operated by operation of said actuator means.

2. The combination of claim 1, said accumulator means comprising a space enclosed over a portion thereof by flexible bladder means.

3. Well apparatus, comprising tubular body means having connection means at its upper and lower ends whereby said apparatus may be lowered into a well connected in a pipe string, pressure accumulator means associated with said tubular body means for holding fluid under pressure and comprising a space enclosed over a portion thereof by flexible bladder means, control valve means for admitting pressuring fluid to pressure fluid within said accumulator from the exterior of said apparatus, means for preventing movement of said control valve means to open to prevent outflow of said pressuring fluid, actuator means exposed to the pressure of fluid within said accumulator at a first surface and exposed to the pressure of fluid at the exterior of said apparatus at a second surface whereby said actuator means may be operated in response to pressure differentials between said pressures at said first and second surfaces, and movable means adapted to be operated by operation of said actuator means, said flexible bladder means having tubular sleeve form and being disposed annularly around said tubular body means to provide said accumulator space therebetween, including means for sealing the ends of said flexible bladder means to said tubular body means, said apparatus including first fluid passage means communicating between said control valve means and the exterior of said flexible bladder means and including second fluid passage means communicating between the interior of said flexible bladder means and said first surface of said actuator means.

4. The combination of claim 3, said actuator means comprising a tubular piston slidably disposed about the passage through said tubular body means and having said first and second surfaces in axially opposed dispositions at exterior portions thereof, sleeve means forming chambers about said exterior portions of said piston one in communication with said second fluid passage means and the other in communication with said fluid at the exterior of said apparatus, said piston being biased to slidably move in one axial direction when said pressure at said first surface exceeds said pressure at said second surface and being biased to slidably move in the other axial direction when said pressure at said second surface exceeds said pressure at said first surface.

5. The combination of claim 4, said movable means comprising a valve ball having a valve passage therethrough, said valve ball being disposed in said tubular body passage against an end of said piston at one side thereof, a slidable tubular seat disposed about said tubular body means passage and having one end thereof resiliently biased against the other side of said valve ball, said valve ball being oppositely rotated by 90° by respective movements of said piston in opposite axial directions to move said valve passage between an opened position aligned with said tubular body passage and a closed position transverse to said tubular passage.

6. The combination of claim 5, said valve ball being pivotally connected to said piston at opposite sides thereof along a transverse axis of said valve ball and being pivotally connected to said sleeve means at opposite sides thereof along a line spaced from and parallel to said transverse axis, said ball being rotated about said transverse axis by movements thereof relative said line when said piston is moved.

7. The combination of claim 6, including a tubular wiper sleeve disposed around the interior of said piston and having one end thereof resiliently biased against said one side of said valve ball.

8. The combination of claim 7, said tubular body means having an outwardly enlarged portion adjacent one end of said accumulator means, said control valve means comprising at least one valve passage having a seat therearound axially through said enlarged portion and a plunger movable between positions spaced from and against said seat disposed in each said valve passage, each said plunger being biased toward a said seat by pressure within said accumulator.

9. The combination of claim 8, each said valve passage being disposed through a rod slidably disposed through a rod passage axially through said outwardly enlarged portion, each said rod being releasably fixed in position by shear pin means in said rod passage, the upper end of each said valve passage being in communication with the exterior of the apparatus through transverse port means through said rod and said outwardly enlarged portion, each said rod being movable by accumulator pressure to shear said shear pin to move said transverse port means out of register one with the other to close said valve passage when said accumulator pressure exceeds exterior pressure by a sufficient amount, whereby said accumulator pressure is protected against change.

10. The combination of claim 3, said tubular body means having an outwardly enlarged portion adjacent one end of said accumulator means, said control valve means comprising at least one valve passage having a seat therearound axially through said enlarged portion and a plunger movable between positions spaced from and against said seat disposed in each said valve passage, each said plunger being biased toward a said seat by pressure within said accumulator.

11. The combination of claim 4, said tubular body means having an outwardly enlarged portion adjacent one end of said accumulator means, said control valve means comprising at least one valve passage having a seat therearound axially through said enlarged portion and a plunger movable between positions spaced from and against said seat disposed in each said valve passage, each said plunger being biased toward a said seat by pressure within said accumulator.

12. The combination of claim 5, said tubular body means having an outwardly enlarged portion adjacent one end of said accumulator means, said control valve means comprising at least one valve passage having a seat therearound axially through said enlarged portion and a plunger movable between positions spaced from and against said seat disposed in each said valve passage, each said plunger being biased toward a said seat by pressure within said accumulator.

13. The combination of claim 6, said tubular body means having an outwardly enlarged portion adjacent one end of said accumulator means, said control valve means comprising at least one valve passage having a seat therearound axially through said enlarged portion and a plunger movable between positions spaced from and against said seat disposed in each said valve passage, each said plunger being biased toward a said seat by pressure within said accumulator.

14. The combination of claim 7, each said valve passage being disposed through a rod slidably disposed through a rod passage axially through said outwardly enlarged portion, each said rod being releasably fixed in position by shear pin means in said rod passage, the upper end of each said valve passage being in communication with the exterior of the apparatus through transverse port means through said rod and said outwardly enlarged portion, each said rod being movable by accumulator pressure to shear said shear pin to move said transverse port means out of register one with the other to close said valve passage when said accumulator pressure exceeds exterior pressure by a sufficient amount, whereby said accumulator pressure is protected against change.

15. Well apparatus, comprising tubular body means having connection means at its upper and lower ends whereby said apparatus may be lowered into a well connected in a pipe string, pressure accumulator means associated with said tubular body means for holding fluid under pressure and comprising a space enclosed over a portion thereof by flexible bladder means, control valve means for admitting pressuring fluid to pressure fluid within said accumulator from the exterior of said apparatus, means for preventing movement of said control valve means to open to prevent outflow of said pressuring fluid, actuator means exposed to the pressure of fluid within said accumulator at a first surface and exposed to the pressure of fluid at the exterior of said apparatus at a second surface whereby said actuator means may be operated in response to pressure differentials between said pressures at said first and second surfaces, and movable means adapted to be operated by operation of said actuator means, said movable means comprising valve means operable between opened and closed positions, said valve means being moved to one of its said opened and closed positions by said actuator means when said pressure at said first surface exceeds said pressure at said second surface and being moved to the other of its said opened and closed positions when said pressure at said second surface exceeds said pressure at said first surface.

16. Well apparatus comprising tubular body means having connection means at its upper and lower ends whereby said apparatus may be lowered into a well connected in a pipe string, pressure accumulator means associated with said tubular body means for holding a separate fluid therein under pressure, control valve means for admitting pressuring fluid to pressure said separate fluid within said accumulator from the exterior of said apparatus, means for preventing movement of said control valve means to open to prevent outflow of said pressuring fluid, actuator means expressed to the pressure of said separate fluid within said accumulator at a first surface and exposed to the pressure of fluid at the exterior of said apparatus at a second surface whereby said actuator means may be operated in response to pressure differentials between said pressures at said first and second surfaces, and movable means adapted to be operated by operation of said actuator means, said tubular body means having an outwardly enlarged portion adjacent one end of said accumulator means, said control valve means comprising at least one valve passage having a seat therearound axially through said enlarged portion and a plunger movable between positions spaced from and against said seat disposed in each said valve passage, each said plunger being biased toward a said seat by pressure within said accumulator.

17. The combination of claim 3, 6, 7, 16, or 9, including means for releasing fluid pressure from said accumulator.

18. The combination of claim 3, 7, 16, or 9, including quantities of oil and gas precharged within said accumulator.

19. Well apparatus, comprising tubular body means having connection means at its upper and lower ends whereby said apparatus may be lowered into a well connected in a pipe string, pressure accumulator means associated with said tubular body means for holding a separate fluid therein under pressure, and comprising a space enclosed over a portion thereof by flexible bladder means, control valve means for admitting pressuring fluid to pressure said separate fluid within said accumulator from the exterior of said apparatus, means for preventing movement of said control valve means to open to prevent outflow of said pressuring fluid, actuator means exposed to the pressure of said separate fluid within said accumulator at a first surface and exposed to the pressure of fluid at the exterior of said apparatus at a second surface whereby said actuator means may be operated in response to pressure differentials between said pressures at said first and second surfaces, and movable means adapted to be operated by operation of said actuator means, said tubular body means having an outwardly enlarged portion adjacent one end of said accumulator means, said control valve means comprising at least one valve passage having a seat therearound axially through said enlarged portion and a plunger movable between positions spaced from and against said seat disposed in each said valve passage, each said plunger being biased toward a said seat by pressure within said accumulator.

20. The combination of claim 5, 6, or 19, said valve ball being moved longitudinally of said tubular body passage to move said slidable tubular seat against its said resilient bias when said valve ball is rotated by 90° in one direction to said closed position, said valve ball being moved longitudinally of said tubular body passage and said slidable tubular seat being moved therewith by said resilient bias when said valve ball is rotated by 90° in the opposite direction to said opened position, a pressure differential of sufficient magnitude across said ball in said one direction in said tubular body passage when said valve ball is in said closed position preventing said valve ball from being moved in said opposite direction to said opened position, whereby said valve ball may not be moved to said opened position unless said pressure differential is reduced, and whereby leaks affecting said pressure at the exterior of the apparatus will not effect movement of said valve ball to said opened position and may thereby be detected.

21. Well apparatus, comprising tubular body means having connection means at its upper and lower ends whereby said apparatus may be lowered into a well connected in a pipe string, pressure accumulator means associated with said tubular body means for holding fluid under pressure, control valve means for admitting pressuring fluid to pressure fluid within said accumulator from the exterior of said apparatus, means for preventing movement of said control valve means to open to prevent outflow of said pressuring fluid, actuator means exposed to the pressure of fluid within said accumulator at a first surface and exposed to the pressure of fluid at the exterior of said apparatus at a second surface whereby said actuator means may be operated in response to pressure differentials between said pressures at said first and second surfaces, and movable means adapted to be operated by operation of said actuator means, said control valve means comprising an inner sleeve and an outer sleeve, said inner sleeve being longitudinally movably disposed within said outer sleeve, aperture means through said inner and outer sleeves movable between positions in alignment and positions out of alignment by relative longitudinal movements of said inner and outer sleeves, said aperture means through one of said inner and outer sleeves communicating with a fluid flow path to the exterior of said apparatus and said aperture means through the other of said inner and outer sleeves communicating with a fluid flow path to said accumulator when said aperture means are positioned in alignment, and means for moving one of said inner and outer sleeves longitudinally to move said aperture means to said out of alignment positions to shut off fluid flow communication through said aperture means and said flow paths between the exterior of said apparatus and said accumulator whereby the pressure of fluid within said accumulator will not be affected by changes in the fluid pressure at the exterior of said accumulator.

22. The combination of claim 21, wherein one of said inner and outer sleeves is connected to said pipe string above said apparatus to be moved longitudinally of the other of said inner and outer sleeves to shut off said fluid flow communication by longitudinal movement of said pipe string above said apparatus.

23. The combination of claim 22, wherein said pipe string above said apparatus is moved upwardly to move said one sleeve longitudinally of said other sleeve.

24. The combination of claim 22, wherein said pipe string above said apparatus is moved downwardly to move said one sleeve longitudinally of said other sleeve.

25. The combination of claim 22, including a threaded connection between said inner and outer sleeves, and wherein said pipe string above said apparatus is rotated about its axis to move said one sleeve longitudinally of said other sleeve.

26. The combination of claim 22, 23, 24, or 25, said inner and outer sleeves being releasably connected by shear pin means which is sheared by initial movement of said pipe string above said apparatus.

27. Well apparatus, comprising tubular body means having connection means at its upper and lower ends whereby said apparatus may be lowered into a well connected in a pipe string, pressure accumulator means associated with said tubular body means for holding fluid under pressure, control valve means for admitting pressuring fluid to pressure fluid within said accumulator from the exterior of said apparatus, means for preventing movement of said control valve means to open to prevent outflow of said pressuring fluid, actuator means exposed to the pressure of fluid within said accumulator at a first surface and exposed to the pressure of fluid at the exterior of said apparatus at a second surface whereby said actuator means may be operated in response to pressure differentials between said pressures at said first and second surfaces, and movable means adapted to be operated by operation of said actuator means, said control valve means comprising sleeve means having aperture means therethrough communicating at its outer end with the exterior of said apparatus and with fluid pressure at the exterior of said apparatus, a control sleeve longitudinally slidably disposed within said sleeve means at said aperture means and being longitudinally movable to open and to close the inner end of said aperture means, said control sleeve having interior connection means for engaging a wireline tool run thereto through said pipe string, whereby said control valve means may be opened and closed by longitudinal movement of said control sleeve by a said wireline tool.

28. The combination of claim 27, said sleeve means and said control sleeve being releasably connected by shear pin means which is sheared by initial movement of said control sleeve by said wireline tool.

29. Well apparatus, comprising tubular body means having connection means at its upper and lower ends whereby said apparatus may be lowered into a well connected in a pipe string, pressure accumulator means associated with said tubular body means for holding fluid under pressure, control valve means for admitting pressuring fluid to pressure fluid within said accumulator from the exterior surface of said apparatus, means for preventing movement of said control valve means to open to prevent outflow of said pressuring fluid, actuator means exposed to the pressure of fluid within said accumulator at a first surface and exposed to the pressure of fluid at the exterior of said apparatus at a second surface whereby said actuator means may be operated in response to pressure differentials between said pressures at said first and second surfaces, and movable means adapted to be operated by operation of said actuator means, said actuator means comprising a piston.

30. The combination of claim 29, including means for releasably latching said piston means against longitudinal movement.

31. The combination of claim 30, said latching means comprising a stationary element of said apparatus, a first member slidable at one side longitudinally along said stationary element, a second member having wire-line tool engagement means and being slidable longitudinally along the other side of said first member and biased in one longitudinal direction of piston movement, aperture means through said first member between said one and other sides thereof, first recess means in the surface of said stationary element against which said one side of said first member is slidable, second recess means in the surface of said second member slidable against said other side of said first member, body means movable transversely within said aperture means to be partially engaged with one or the other of said first and second recess means while still partially engaged within said aperture means, said first member being connected to said piston means, said body means being partially engaged with each of said aperture and said second recess means when said piston is in one longitudinal position and said body means engagement moving said second member in said first direction of piston movement from said first longitudinal position to a second longitudinal position when said piston is moved in said one longitudinal direction to move said body means to said first means to be moved partially thereinto by said bias of said second member in said first direction of piston movement to latch said piston against opposite movement back to said first longitudinal position, said means being moved transversely through said aperture means partially back into said second recess means when said piston means is biased toward its said first longitudinal position and said second member is moved against its said bias by a wireline tool engaged therewith, whereby when said piston has been moved from its said first position to its said second position it may not be moved back to its said first position until said second member has been moved against its said bias by a said wireline tool.

32. Method for providing operation of apparatus downhole in a well, comprising running a pressure accumulator of variable internal volume containing a separate fluid at an initial pressure into a well from the surface with at least a portion of the exterior of said accumulator exposed to fluid pressure in the well increasing the fluid pressure in the well to above hydrostatic pressure, whereby the internal volume of the accumulator is reduced in response to said increased fluid pressure in the well to increase said initial pressure in the accumulator to a higher final fluid pressure, and lowering said fluid pressure in the well to operate apparatus downhole in the well by application of the differential between said higher final fluid pressure and said fluid pressure in the well across a piston.

33. Method according to claim 32, including maintaining the highest pressure of said fluid pressure in the well reached prior to said varying thereof for apparatus operation at said portion of the exterior of said accumulator.

34. Method for providing operation of apparatus downhole in a well, comprising running a pressure accumulator of variable internal volume containing fluid at an initial pressure into a well from the surface with at least a portion of the exterior of said accumulator exposed to fluid pressure in the well, whereby the internal volume of the accumulator is reduced in response to said fluid pressure in the well to increase said initial pressure in the accumulator to a higher final fluid pressure, and varying said fluid pressure in the well to operate apparatus downhole in the well by application of the differential between said final fluid pressure and said fluid pressure in the well across a piston, including maintaining the highest pressure of said fluid pressure in the well reached prior to said varying thereof for apparatus operation at said portion of the exterior of said accumulator, including closing fluid communication between the exterior of said apparatus and said portion of the exterior of said accumulator to prevent variation thereafter of said final fluid pressure.

35. Method for charging a fluid pressure accumulator, said accumulator including means for equalizing internal accumulator pressure with casing hydrostatic fluid pressure external of said accumulator, comprising precharging the interior of the accumulator with compressible fluid at an initial pressure at the surface, running the accumulator into a well through fluid in the well at normal hydrostatic casing pressure, increasing the hydrostatic casing pressure to increase the pressure within the accumulator to a final pressure substantially greater than the normal hydrostatic casing pressure in the casing at the location in the well to which the accumulator is run and decreasing the casing pressure to normal hydrostatic casing pressure.

36. Method according to claim 35, including sealing said means for equalizing internal accumulator pressure with pressure external of said accumulator from fluid pressure in the well after said final pressure has been reached to prevent variation thereafter of said final pressure because of variations of said fluid pressure in the well.

37. Well apparatus, comprising tubular body means having connection means at its upper and lower ends whereby said apparatus may be lowered into a well connected in a pipe string, pressure accumulator means associated with said tubular body means for holding fluid under pressure, control valve means for admitting pressuring fluid to pressure fluid within said accumulator from the exterior of said apparatus, means for preventing movement of said control valve means to open to prevent outflow of said pressuring fluid, actuator means exposed to the pressure of fluid within said accumulator at a first surface and exposed to the pressure of fluid at the exterior of said apparatus at a second surface whereby said actuator means may be operated in response to pressure differentials between said pressures at said first and second surfaces, and movable means adapted to be operated by operation of said actuator means, said accumulator means comprising a chamber closed by a free-floating piston at one side thereof, one side of said free-floating piston being exposed to fluid pressure within said accumulator means and the other side of said free-floating piston being exposed to said pressured fluid admitted through said control valve to cause pressuring of the fluid within said accumulator.

38. Well apparatus, comprising tubular body means having connection means at its upper and lower ends whereby said apparatus may be lowered into a well connected in a pipe string, pressure accumulator means associated with said tubular body means for holding fluid under pressure and comprising a space enclosed over a portion thereof by flexible bladder means, control valve means for admitting pressuring fluid to pressure fluid within said accumulator from the exterior of said apparatus, means for preventing movement of said control valve means to open to prevent outflow of said pressuring fluid, actuator means exposed to the pressure of fluid within said accumulator at a first surface and exposed to the pressure of fluid at the exterior of said apparatus at a second surface whereby said actuator means may be operated in response to pressure differentials between said pressures at said first and second surfaces, and movable means adapted to be operated by operation of said actuator means, said flexible bladder means having tubular sleeve form and being disposed annularly around said tubular body means to provide said accumulator space therebetween, including means for sealing the ends of said flexible bladder means to said tubular body means, said apparatus including first fluid passage means communicating between said control valve means and the exterior of said flexible bladder means and including second fluid passage means communicating between the interior of said flexible bladder means and said first surface of said actuator means, said movable means comprising valve means operable between opened and closed positions, said valve means being moved to one of its said opened and closed positions by said actuator means when said pressure at said first surface exceeds said pressure at said second surface and being moved to the other of its said opened and closed positions when said pressure at said second surface exceeds said pressure at said first surface.

39. Well apparatus, comprising tubular body means having connection means at its upper and lower ends whereby said apparatus may be lowered into a well connected in a pipe string, pressure accumulator means associated with said tubular body means for holding fluid under pressure, control valve means for admitting pressuring fluid to pressure fluid within said accumulator from the exterior surface of said apparatus, means for preventing movement of said control valve means to open to prevent outflow of said pressuring fluid, actuator means exposed to the pressure of fluid within said accumulator at a first surface and exposed to the pressure of fluid at the exterior of said apparatus at a second surface whereby said actuator means may be operated in response to pressure differentials between said pressures at said first and second surfaces, and movable means adapted to be operated by operation of said actuator means, said accumulator means comprising a space enclosed over a portion thereof by flexible bladder means, including means for releasing fluid pressure from said accumulator.

40. Well apparatus, comprising tubular body means having connection means at its upper and lower ends whereby said apparatus may be lowered into a well connected in a pipe string, pressure accumulator means associated with said tubular body means for holding a separate fluid therein under pressure, control valve means for admitting pressuring fluid to pressure said separate fluid within said accumulator from the exterior surface of said apparatus, means for preventing movement of said control valve means to open to prevent outflow of said pressuring fluid, actuator means exposed to the pressure of said separate fluid within said accumulator at a first surface and exposed to the pressure of fluid at the exterior of said apparatus at a second surface whereby said actuator means may be operated in response to pressure differentials between said pressures at said first and second surfaces, and movable means adapted to be operated by operation of said actuator means, said accumulator means comprising a space enclosed over a portion thereof by flexible bladder means including means for releasing fluid pressure from said accumulator.

41. Well apparatus, comprising tubular body means having connection means at its upper and lower ends whereby said apparatus may be lowered into a well connected in a pipe string, pressure accumulator means associated with said tubular body means for holding a separate fluid therein under pressure, control valve means for admitting pressuring fluid to pressure said separate fluid within said accumulator from the exterior surface of said apparatus, means for preventing movement of said control valve means to open to prevent outflow of said pressuring fluid, actuator means exposed to the pressure of said separate fluid within said accumulator at a first surface and exposed to the pressure of fluid at the exterior of said apparatus at a second surface whereby said actuator means may be operated in response to pressure differentials between said pressures at said first and second surfaces, and movable means adapted to be operated by operation of said actuator means, said accumulator means comprising a space enclosed over a portion thereof by flexible bladder means, including quantities of oil and gas precharged within said accumulator.

42. Well apparatus, comprising tubular body means having connection means at is upper and lower ends whereby said apparatus may be lowered into a well connected in a pipe string, pressure accumulator means associated with said tubular body means for holding a separate fluid therein under pressure, control valve means for admitting pressuring fluid to pressure said separate fluid within said accumulator from the exterior surface of said apparatus, means for preventing movement of said control valve means to open to prevent outflow of said pressuring fluid, actuator means exposed to the pressure of said separate fluid within said accumulator at a first surface and exposed to the pressure of fluid at the exterior of said apparatus at a second surface whereby said actuator means may be operated in response to pressure differentials between said pressures at said first and second surfaces, and movable means adapted to be operated by operation of said actuator means, including quantities of oil and gas precharged within said accumulator.

* * * * *